United States Patent [19]

Inoue et al.

[11] 4,173,916

[45] Nov. 13, 1979

[54] TONE GENERATOR SYSTEM FOR AN ELECTRONIC ORGAN

[75] Inventors: Michihiro Inoue; Takeji Kimura, both of Hirakata; Masaharu Sato, Moriguchi; Masahiko Tsunoo, Suita, all of Japan

[73] Assignee: Matsushita Electric Industrial Co., Ltd., Osaka, Japan

[21] Appl. No.: 824,802

[22] Filed: Aug. 15, 1977

Related U.S. Application Data

[62] Division of Ser. No. 622,383, Oct. 14, 1975, Pat. No. 4,056,033.

[30] Foreign Application Priority Data

| | | | |
|---|---|---|---|
| Oct. 18, 1974 | [JP] | Japan | 49-120763 |
| Oct. 18, 1974 | [JP] | Japan | 49-120806 |
| Oct. 23, 1974 | [JP] | Japan | 49-122663 |
| Nov. 18, 1974 | [JP] | Japan | 49-132981 |
| Nov. 19, 1974 | [JP] | Japan | 49-133991 |
| Apr. 18, 1975 | [JP] | Japan | 50-47740 |

[51] Int. Cl.[2] ..... G10H 3/00; G10H 1/02

[52] U.S. Cl. ..... 84/1.09; 84/113; 84/1.26; 84/DIG. 23

[58] Field of Search ..... 84/1.08, 1.09, 1.13, 84/1.26, DIG. 8, DIG. 23; 307/246, 264, 268, 251, 261, 304

[56] References Cited

U.S. PATENT DOCUMENTS

| | | | |
|---|---|---|---|
| 3,637,915 | 1/1972 | Hirano | 84/1.13 |
| 3,656,008 | 4/1972 | Nakagomi | 307/268 |
| 3,708,603 | 1/1973 | Reagle et al. | 84/1.11 |
| 3,746,775 | 7/1973 | Uchiyama | 84/1.26 |

FOREIGN PATENT DOCUMENTS 48-62417 8/1973 Japan .

*Primary Examiner*—Vit W. Miska
*Attorney, Agent, or Firm*—Spencer & Kaye

[57] ABSTRACT

A tone generator system for an electronic organ which is capable of being fabricated into an LSI structure and receives a saw-tooth wave or staircase wave as an input thereto comprises a frequency divider for the saw-tooth wave or staircase wave including a ladder resistor network and a complementary MOS FET devices, an analog switch having a wide dynamic range and a high linearity in input-output transfer characteristic constructed by MOS FET devices to serve as an indirect keying means, a sustain means including a novel structure of a variable impedance element which is constructed to control a channel current in a MOS FET device by varying a potential distribution in a source region, and an impedance converter constructed by complementary MOS FET devices and free from a D.C. level shift. With the above arrangement a tone generator system of high quality for an electronic organ is provided.

7 Claims, 44 Drawing Figures

VG2: GATE VOLTAGE OF THE TRANSISTOR 229

TONE GENERATOR SYSTEM FOR AN ELECTRONIC ORGAN

This is a Division of application Ser. No. 622,383 filed Oct. 14, 1975, now U.S. Pat. No. 4,056,033.

The present invention relates to a tone generator system for an electronic organ, and more particularly to frequency dividing means for a sawtooth wave and a staircase wave, output means and indirect keying means in the tone generator system and capable of being fabricated into a monolithic LSI structure.

While a square wave signal has been mainly used as a tone signal for an electronic musical instrument because of the ease of frequency division, it produces an imperfect musical sound because the frequency components thereof do not include even harmonics. To overcome the above difficulty, it has been proposed to use a saw-tooth wave or staircase wave. In the case of the staircase wave, high order even harmonics are missed depending on the number of steps of the staircase wave. By selecting the design such that the missing components lie beyond the upper limit of the audio frequency range, substantially the same tone effect as that produced by the saw-tooth wave can be attained. The saw-tooth wave or staircase wave has not actually been used in many applications because the frequency division of those waveforms has been difficult or required a very complicated circuit and hence the circuit has been expensive.

In one known frequency divider circuit for the saw-tooth wave, an input saw-tooth wave and a square wave having a repetition rate of one half of that of the input saw-tooth wave are added at an amplitude ratio of 1:1. In such a system, there has been a drawback in that when a multiple frequency division is effected the errors in the addition ratios and the distortions due to nonlinearity of the circuits in all of the preceding stages are accumulated so that the output waveforms and the frequency spectra in the trailing stages substantially differ from those of the saw-tooth wave.

Further, in an electronic organ it is required to interrupt the musical signal by the operation of a keyboard. As a first method therefor, a direct keying system in which the musical signal is directly interrupted by a keying switch itself has been known. This method, however, cannot allow envelope control of the leading edge and the trailing edge of the musical signal and it is also not advisable from the standpoint of reliability. As a second method an indirect keying system is known in which a semiconductor device is used so that the musical signal is interrupted depending on the bias condition at a control terminal. In a prior art indirect keying circuit, however, since the linearity of the transfer characteristic was poor and the dynamic range was not sufficiently wide, the signal wave to be handled was mainly a square wave although analog signal switching and envelope control were effected. When the saw-tooth wave or the staircase wave was switched, the spectrum of the resulting output waveform did not sufficiently coincide with that of the input waveform. A system having high linearity of transfer characteristic required a complex circuit and it was difficult to construct the system as an integrated semiconductor device which was integral with a tone signal frequency divider circuit.

As another factor which is essential to the tone generator for the electronic organ, the control of rise time and fall time of keying should be considered. Especially the control of the falling characteristic (hereinafter referred to as sustain) may be considered to be associated with a keying means and it is desirable from the standpoint of the simplification of the construction to integrate it with the tone signal frequency divider circuit and the indirect keying means. It is further required that the characteristic thereof be as close to a decay characteristic of a natural musical instrument as possible.

The indirect keying circuit comprising MOS FET devices in the prior art keyboard type electronic musical instrument has a high gate input impedance so that a sustain function can be attained by connecting a charging capacitor and a discharging impedance element is parallel with a gate circuit. The discharging impedance element used in the prior art includes a variable resistor and a drain-source ON resistance of a MOS transistor having a gate as a control terminal. In case of the variable resistor, the sustain time is varied by changing the resistance and hence it is not possible to integrate the resistor element in a chip in which the indirect keying circuit is incorporated. Further, it is often desired to simultaneously change the durations of the sustain time for all keys, and in such a case it is required to operate a number of variable resistors in linked manner. This would be practically difficult in many aspects. As an approach to overcome the above difficulty it is known to use the drain-source ON resistance of the MOS transistor device having the gate thereof as the control terminal. In this case the musical signal decay curve of the sustain shows a gentle decay in a front half of the sustain and a sharp decay in a rear half so that it presents an unnatural sound feeling to the audience and hence introduces practical problem. More particularly, the drainsource ON resistance of the MOS FET approximates a constant current characteristic, and the increase in current due to the increase in voltage tends to be decreased to compare with a proportional relationship. Thus, the change in time of the gate voltage of the indirect keying MOS FET shows a curve which is intermediate an exponential decay curve and a linear decay curve. Accordingly, in a circuit in which the relation between the gate voltage of the keying MOS FET in the indirect keying circuit and the output amplitude thereof is linear or the increase in the output amplitude due to the increase in the gate voltage tends to be decreased to compare with a proportional relationship, the resulting musical signal decay curve has smaller decay in the front half than the exponential decay curve and has larger decay in the rear half, and hence it presents an unnatural decay feeling to the audience. In many natural musical instruments, the decay curve is exponential or has a sharp decay at the beginning stage and a gentle decay in the rear half. In such a case it presents a natural decay feeling to the audience.

It is, therefore, an object of the present invention to overcome the above drawbacks of the prior art and to provide a tone generator system of a high quality for an electronic organ.

It is another object of the present invention to provide a tone generator system for an electronic organ which can be fabricated into an LSI structure.

A first feature of the present invention resides in a frequency divider circuit for the saw-tooth wave and staircase wave which is simple in construction and in which errors among frequency divided outputs are small and the frequency spectra of the frequency divided output waveforms are close to those of perfect saw-tooth or staircase waves. Another feature resides in the fact that an entire circuit can be constructed on one semiconductor substrate using MOS FET devices. Major component to attain the above frequency divider circuit are series connected square wave frequency divider circuits, R-2R ladder resistor network and switches. Since only one or two kinds of resistance values are required it is easy to prepare matched element in constructing the circuit and any other circuit component of high accuracy is not required.

A second feature of the present invention is that an analog switch which has a wide dynamic range and linear transfer characteristic can be constructed by the series connection of three FET devices and the above analog switch may be used as an indirect keying means for the tone generator system of the electronic organ to switch the saw-tooth wave or staircase wave to attain an indirect keying system in which the frequency spectra of the output waveforms are close to those of the perfect saw-tooth wave or staircase wave. Another feature resides in the fact that the above indirect keying system can be readily constructed on the same semiconductor substrate as that on which the above frequency divider circuit is mounted.

In accordance with the second feature of the present invention, at the time of rise or fall of the switched musical signal or when the amplitude control is effected, the harmonic component ratio varies so that a musical signal close to a natural musical instrument sound is generated.

It has been generally known from various analysis that the harmonics component ratio at the time of rise or fall of the musical signal in the natural musical instrument tends to include a greater fundamental wave component content and less high order harmonic component content as the amplitude becomes smaller. Therefore, in the present indirect keying system using the analog switch, it has been designed such that the fundamental component content is high relative to the high order harmonic component content when the amplitude is small. Further, it should be understood that the analog switch of the present invention can be used not only as the indirect keying system for the electronic organ but also in other applications as a conventional analog switch.

A third feature of the present invention is that a natural sustain decay curve which is close to that of the natural musical instrument is attained by constructing the sustain circuit with discharging elements of novel structure. The discharging elements can be integrated with the elements of the above indirect keying system on the same semiconductor substrate. As stated above, it is generally known that the harmonic component ratio at the rise or fall of the musical sound of the natural musical instrument tends to include a greater fundamental component content and less high order harmonic component content as the amplitude becomes smaller. Therefore, the sustain system of the present invention is designed such that a greater fundamental component is included as the amplitude decreases. Another feature is that the frequency divider circuit for the saw-tooth wave and staircase wave, the indirect keying system and the sustain system as described in connection with the first, second and third features are integrated on the same semiconductor substrate to provide the tone generator system of the saw-tooth wave and staircase wave for the electronic organ, which is simple in construction and inexpensive and has a high performance.

A fourth feature of the present invention resides in an output system for the frequency divider circuit for the saw-tooth wave and staircase wave in which an impedance converter which reduces the output impedance while maintaining a low distortion ratio is integrated with the above frequency divider circuit for the saw-tooth wave and staircase wave on the same semiconductor substrate.

In the past it has been rare to process an analog signal with MOS FET devices, and while the digital section of a system such as digital processing section for an analog signal or a section for generating an analog signal by digital control might have been incorporated in one chip, the digital-to-analog (D/A) converter section and the output section necessarily included bipolar transistors. This was because the analog processing with the MOS FET devices was difficult. The main reason therefor is that the mutual conductance gm of the MOS FET is smaller than that of a bipolar transistor of the same area and a suitable circuit system therefor has not been devised.

On the other hand, because of its advantage of a high input impedance, the MOS FET devices have been used as input means for an operational amplifier or the like. In this manner a high input impedance by the MOS FET and a low output impedance by the bipolar transistor have been attained. However, this requires the addition of a discrete MOS FET or two separate chips of the bipolar transistor and the MOS FET, respectively, and it has been difficult to incorporate those in one chip in a normal process. It has thus been necessary to add at least one chip process to the bipolar process or to develop a completely different, special process.

The present invention provide a one-chip impedance converter of high performance without requiring any additional process or special process and without changing the prior art complementary MOS FET process while attaining a low output impedance of the frequency divider circuit for the saw-tooth wave and staircase wave. The impedance converter circuit of the present invention can be used not only in the tone generator system for the electronic organ but also as a conventional impedance converter circuit.

The above and other objects, features and advantages of the present invention will become more apparent from the following detailed description of the preferred embodiments of the invention when taken in conjunction with the accompanying drawings, in which.

Figure 1:
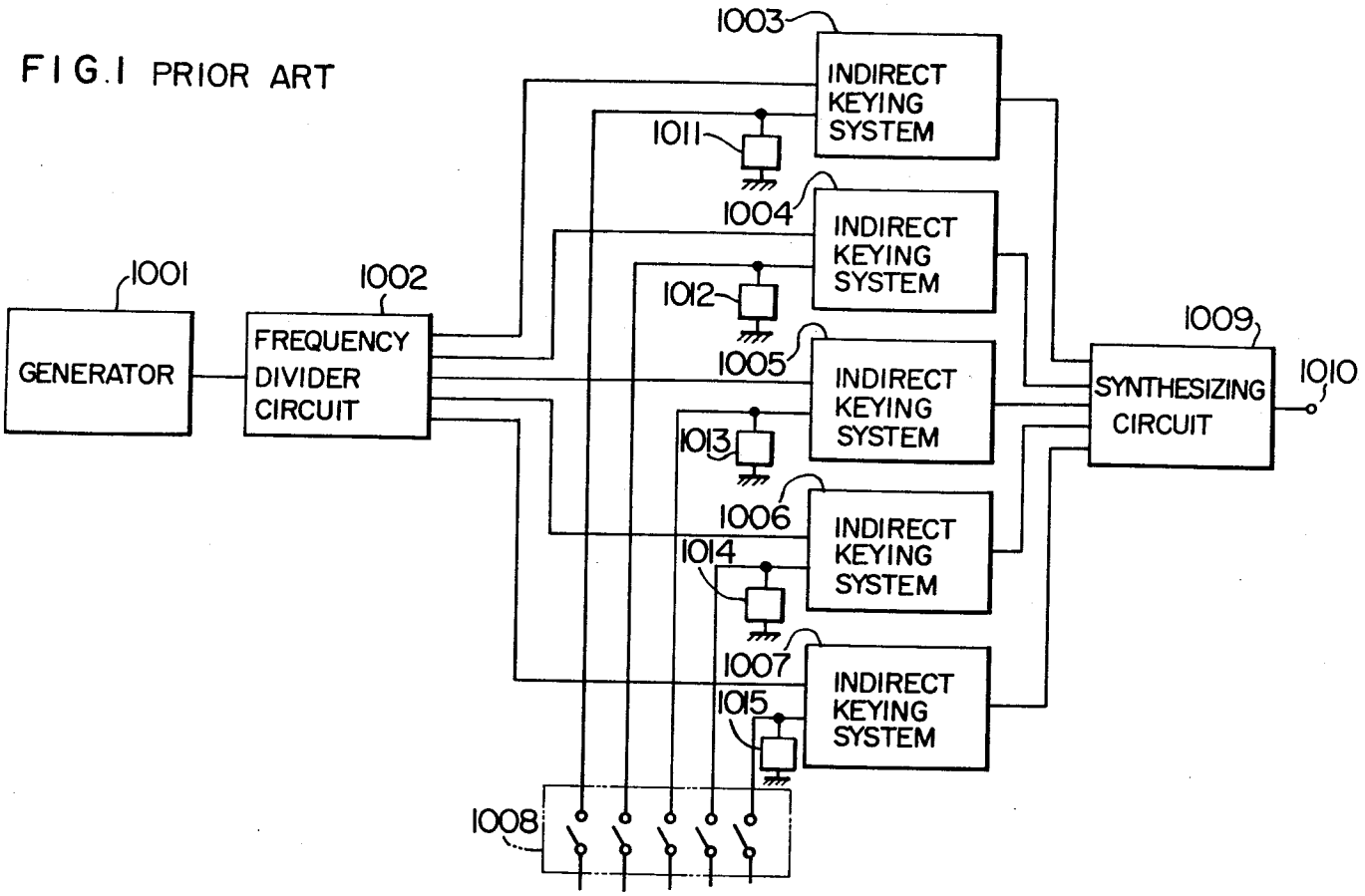
FIG. 1 PRIOR ART
FIG. 1 is a block diagram of a tone generator system for an electronic organ known in the art.

Referring to FIG. 1, a block diagram of a known tone generator system of an electronic organ is shown using a square wave signal generator circuit of a saw-tooth wave generator circuit used as an original signal wave generator.

FIG. 1 shows a construction of a tone generator of an electronic organ known in the art. It doesn't show a construction for the gamut, but a portion which generates five octaves of one note (e.g., a note c). For the other eleven notes (C#-B), it is possible to construct a complete tone generator by additionally arranging eleven circuit constructions, each of which being similar to that of FIG. 1.

The circuit construction of FIG. 1 comprises a generator 1001 which generates as an original oscillation signal a square wave signal and saw-tooth wave or staircase wave signal, frequency divider circuit 1002 dividing into five stages in this case, indirect keying circuits 1003, 1004, 1005, 1006 and 1007 which respectively turn on and off the frequency-divided signals from the frequency divider circuit 1002 according to an opening or closing of a keyboard 1008, and send them to a synthesizing circuit 1009 having an output terminal 1010. Sustain means 1011–1015 are associated with indirect keying systems 1003–1007.

While FIG. 1 shows the main parts of the tone generator system of an electronic organ, in the present invention, novel and improved component such as a frequency divider, indirect keying system and impedance conversion circuit for lowering the output impedance of the frequency divider circuit are proposed.

A first feature of the present invention resides in a saw-tooth wave or staircase wave frequency divider circuit which mainly comprises series connected square wave frequency divider circuits, an R-2R ladder resistor network and switches. Since only one or two resistance values are required it is easy to prepare matched elements in constructing the circuit and other circuit components of high accuracy are not required.

The above feature of the present invention will now be explained in conjunction with the preferred embodiments. While a saw-tooth wave is used as an input signal in the following explanation of the embodiments, it should be understood that the same circuit is equally applicable when a staircase wave or the like is used as the input signal.

Figure 2:
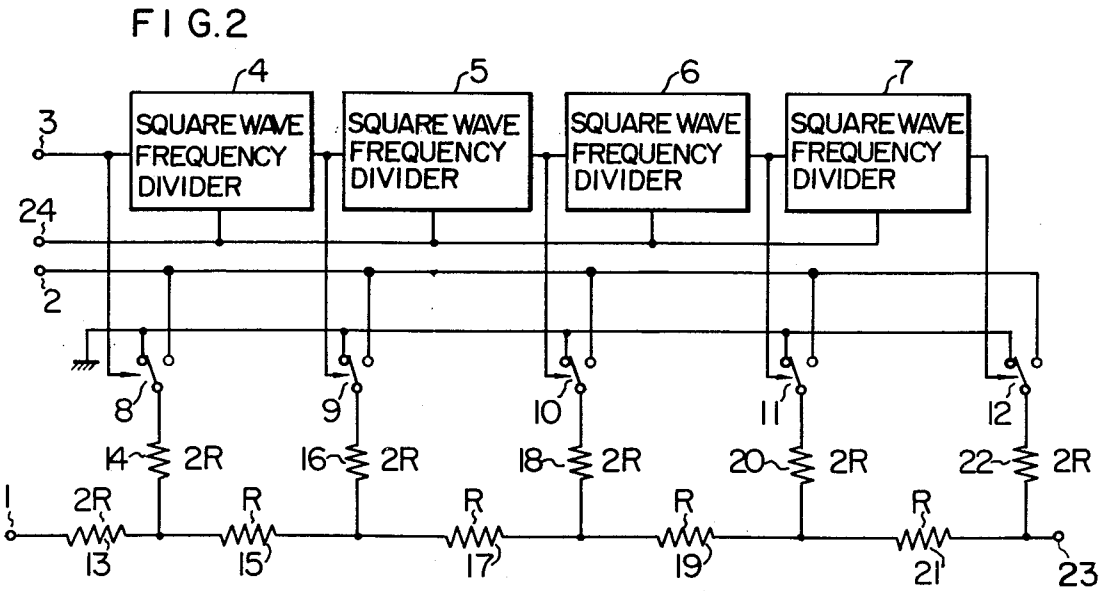
FIG. 2 is a circuit diagram of one embodiment of a frequency divider circuit for a saw-tooth wave and staircase wave in accordance with the present invention.

The circuit shown in FIG. 2 comprises a sawtooth wave voltage signal input terminal 1, a reference power source input terminal or a constant voltage input terminal 2, a square wave signal input terminal 3, square wave frequency dividers 4–7, electronic switches 8–12, resistors 13, 14, 16, 18, 20, 22 each having the resistance of 2R, resistors 15, 17, 19, 21 each having a resistance of R, an output terminal for a frequency divided saw-tooth wave 23, and a reset signal input terminal 24. Resistors R and 2R constitute a ladder resistance network.

Figure 3:
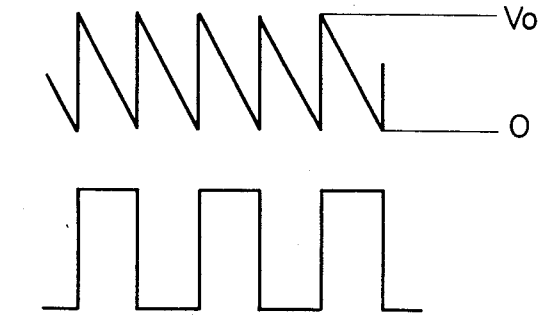
FIG. 3 shows waveforms of the circuit shown in FIG. 2.
Figure 4:
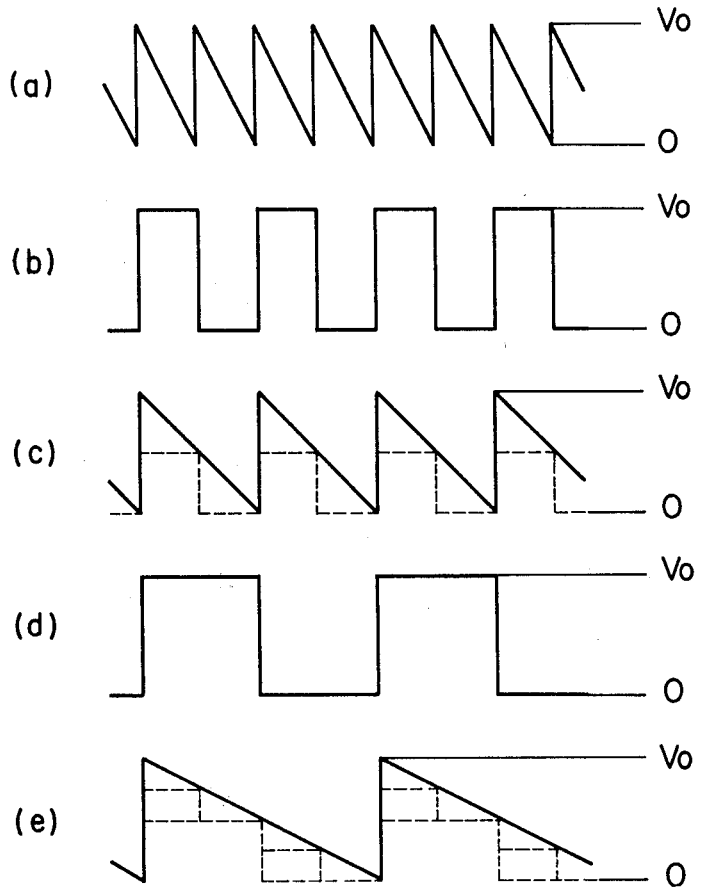
FIG. 4 shows waveforms for illustrating the operation of the circuit shown in FIG. 2.

In the above arrangement, a square wave signal supplied to the terminal 3 is one which is in synchronism with a saw-tooth wave applied to the terminal 1 and has a repetition frequency which is one half that of the saw-tooth wave. The square wave signal to the terminal 3 is shown in FIG. 3(*b*) while the input signal to the terminal 1 is shown in FIG. 3(*a*). As shown in FIG. 4(*a*) the saw-tooth wave having an amplitude $V_O$ is applied to the terminal 1 while a constant voltage having the same magnitude $V_O$ is applied to the terminal 2. Each of the electronic switches 8–12 switches the connecting contacts under the control of the output of the associated frequency divider.

Therefore, the voltages applied to upper terminals of the resistors 14, 16 through the switches 8, 9, respectively, are square wave voltages as shown in FIGS. 4(*b*) and (*d*). Similarly, the voltages applied to upper terminals of the resistors 18, 20, 22 through the switches 10, 11, 12 are square waves each having the magnitude $V_O$ with their periods changing by the factor of 2, 4 and 8, respectively.

Assuming that the voltages supplied to the terminal 1 and the upper terminals of the resistors 14, 16, 18, 20, 22 through the switches 8–12 are $V_1(t)$, $V_2(t)$, $V_3(t)$, $V_4(t)$, $V_5(t)$ and $V_6(t)$, respectively, a voltage $V_{out}(t)$ at the terminal 23 is represented by the following formula;

$$V_{out}(t) = \frac{1}{2} V_6(t) + \frac{1}{4} V_5(t) + \frac{1}{8} V_4(t) + \frac{1}{16} V_3(t) + \frac{1}{32} V_2(t) + \frac{1}{32} V_1(t) \quad (1)$$

Since the amplitudes of $V_1(t)$–$V_6(t)$ are $V_O$, the amplitude of $V_{out}(t)$ is also $V_O$. FIG. 4(*c*) shows an example of the frequency division, by the factor of 2, of the saw-tooth wave by the synthesis of one step of square wave and the saw-tooth wave, and FIG. 4(*e*) shows an example of the frequency division, by the factor of 4, of the saw-tooth wave by the synthesis of two steps of square wave and the saw-tooth wave. The example shown in FIG. 2 and by the formula (1) illustrates the frequency division, by the factor of 32, of the saw-tooth wave by the synthesis of five steps of square wave and the saw-tooth wave and produce the saw-tooth wave of the amplitude $V_O$ in the same manner as in FIG. 4(*e*).

Thus, it is one of the features of the present circuit that a saw-tooth wave output of a constant amplitude $V_O$ is always produced regardless of the number of stages of the frequency divider circuit. The terminal 24, which is the reset terminal, is used to keep other frequency divider circuits, which are operated simultaneously, in phase.

While the above explanation was directed to the application where the input signal was the saw-tooth wave, it should be readily understood that the same frequency division operation will be attained for a staircase input. In this case, since the frequencies of the eliminated high order even harmonics in the frequency divided signal are constant regardless of the number of stages of the frequency division the same quality of tone as that obtained by the saw-tooth wave is assured if the circuit is designed such that the eliminated components lie above the upper limit of the audio frequency range.

In accordance with the present invention, the resistance values of the high precision resistors required in the circuit are R and 2R and since the resistance value of 2R can be easily attained by the series connection of two R resistors, only one resistance value is actually required. This is a very advantageous feature in mass producing the present circuit. Namely, when the circuit is to be constructed with discrete components, those resistor elements which were manufactured from the same material in the same lot may be used so that resistor elements having uniform characteristics and matched temperature coefficients may be used at a low cost. Further, when the present circuit is to be constructed in an integrated structure, the shape, size and orientation in a chip, of the resistor elements can be matched so that closely matched elements of high precision can be attained. It should be also understood that the present invention is not limited to the frequency division of the saw-tooth wave or the staircase wave but applicable to the frequency division of other similar waveforms.

Figure 5:
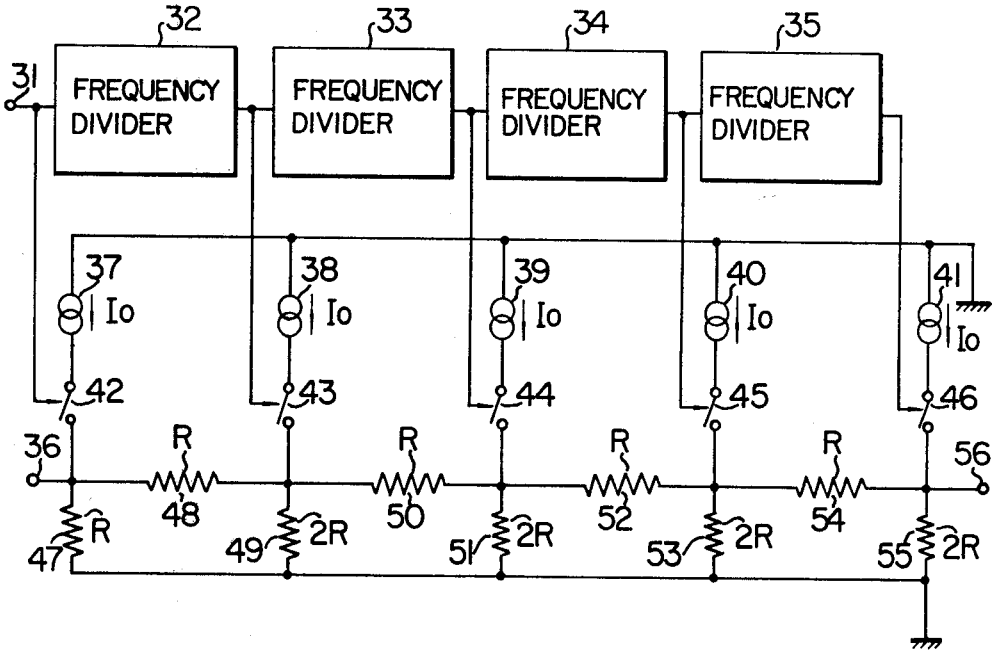
FIG. 5 is a circuit diagram of another embodiment of the frequency divider circuit for the saw-tooth wave and staircase wave in accordance with the present invention.

While the above description has been based on an application where the reference source was a constant voltage source, an embodiment in which a current source is used as the reference source will now be described in conjunction with FIG. 5. The circuit shown in FIG. 5 comprises frequency dividers 32–35, a saw-tooth wave current input terminal 36, constant current sources 37–41, electronic switches 42–46, resistors 47, 48, 50, 52, 54 each having a resistance value R, resistors 49, 51, 53, 55 each having a resistance value 2R, a square wave signal input terminal 31 and a frequency divided saw-tooth wave output terminal 56.

A signal supplied to the terminal 31 is one which is in synchronism with a saw-tooth wave applied to the terminal 36 and has a repetition frequency which is one half that of said saw-tooth wave. It may be a simple way to apply to the terminal 31 the input signal to the terminal 36 through a one-stage frequency divider. In this case, since the saw-tooth current source is connected to the terminal 36 a series resistor may be connected to the terminal 36 and a voltage across the resistor may be coupled to a differential amplifier. Alternatively, a trigger signal taken out of an intermediate point of the saw-tooth wave current generator circuit which feeds to the terminal 36 may be frequency divided.

Figure 6:
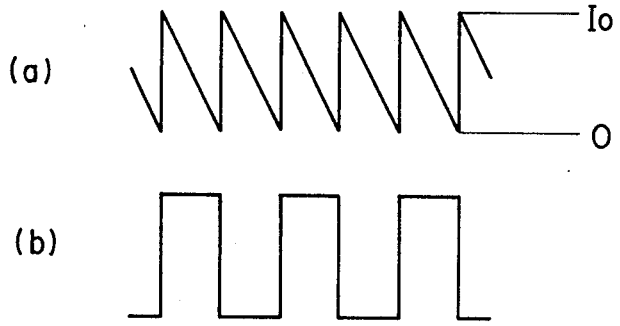
FIG. 6 shows waveforms of the circuit shown in FIG. 5.
Figure 7:
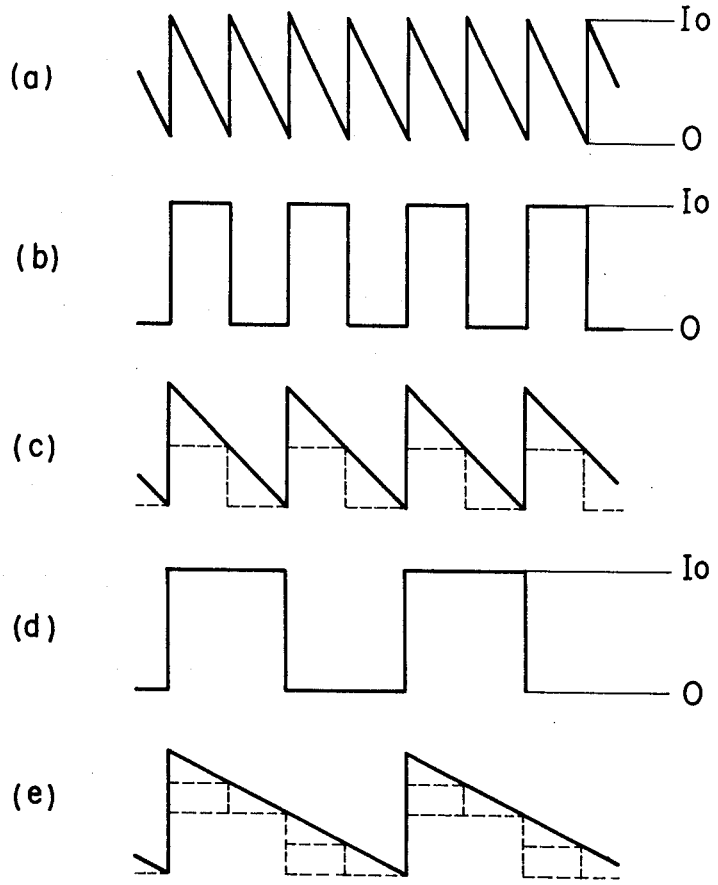
FIG. 7 shows waveforms for illustrating the operation of the circuit shown in FIG. 5.

The signal at the terminal 31 is shown in FIG. 6(*b*) when an input signal as shown in FIG. 6(*a*) is applied to the terminal 36. As also shown in FIG. 7(*a*) the saw-tooth wave current of the amplitude $I_O$ is applied to the terminal 36 and the magnitude of the currents from the constant current sources 37–41 are also set to $I_O$. The currents flowing into the R-2R resistor network through the switches 42 and 43 are square wave currents as shown in FIGS. 6(*b*) and (*d*), respectively. Thus, the currents supplied to the R-2R resistor network through the switches 44–46 are also square waves with their periods changing by the factor of 2, 4 and 8, respectively. Assuming that the currents supplied to the terminal 36 and to the R-2R ladder resistor network through the switches 42–46 are $I_1(t)$, $I_2(t)$, . . . $I_6(t)$, respectively, the voltage $V_{out}(t)$ at the terminal 56 can be expressed by the following formula;

$$V_{out}(t) = R\left\{\frac{1}{2} I_6(t) + \frac{1}{4} I_5(t) + \frac{1}{8} I_4(t) + \frac{1}{16} I_3(t) + \frac{1}{32} I_2(t) + \frac{1}{32} I_1(t)\right\} \quad (2)$$

Since the amplitude of $I_1(t)$–$I_6(t)$ is $I_O$, the amplitude of $V_{out}(t)$ is $I_O R$. This relation is shown in FIGS. 7(*c*) and (e). FIG. 7(*c*) illustrates an example of the synthesis of a one-step square wave and a saw-tooth wave while FIG. 7(*e*) illustrates an example of the synthesis of two steps of square wave and a saw-tooth wave. As seen from FIGS. 7(*c*) and (e) and from the formula (2), the present arrangement is advantageous in that an output of a constant amplitude $I_O R$ is always attained regardless of the number of steps of frequency division.

A specific circuit to be used in implementing the first aspect of the present invention in a practical tone generator system of an electronic organ is now explained.

Figure 8:
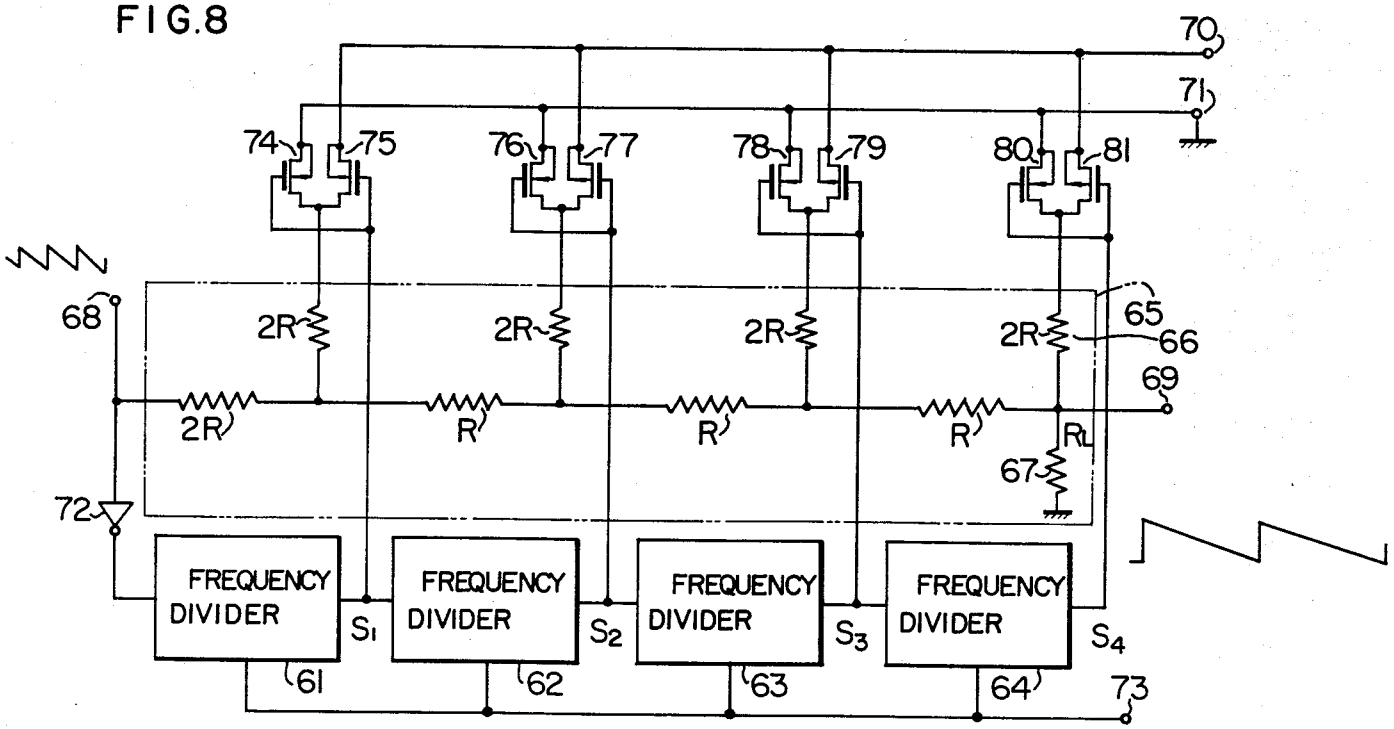
FIG. 8 is a circuit diagram of one embodiment which embodies the circuit shown in FIG. 2.

FIG. 8 shows the specific circuit, the operation of which is explained with reference to the drawing.

Referring to FIG. 8, the circuit comprises ½ - frequency dividers 61, 62, 63, 64 each being inverted at a rise of an input signal, a ladder resistance network 65 comprising resistors of resistance values R, 2R and $R_L$ and terminated by a resistor 66 of 2R and a resistor 67 of $R_L$ with one of the terminating resistor 67 being adapted to assume any resistance value, electronic switches 74–81 including complementary MOS FETs' for selectively connecting one terminals of the 2R resistors in the resistance network 65 to one of the two reference voltage sources by the output signals $S_1$–$S_4$ of the frequency dividers 61–64, an input terminal to which an input saw-tooth wave voltage is applied, an output terminal 69, terminals 70 and 71 to each of which a reference D.C. voltage is applied, an inverter 72 for shaping and polarity inversion, and a reset terminal 73 similar to the terminal 24 shown in FIG. 1.

A saw-tooth wave voltage applied to the terminal 68 is inverted and shaped by the inverter 72, and frequency divided by the square wave frequency dividers 61–64 so that the outputs $S_1$, $S_2$, $S_3$ and $S_4$ of the respective stages produce square wave signals having the repetition frequencies which are ½, ¼, ⅛ and 1/16 of that of the input saw-tooth wave. The outputs $S_1$, $S_2$, $S_3$, $S_4$ of the respective frequency divider stages are then applied to gates of four sets of complementary MOS FETs' each having a source of a P-channel FET connected to the reference voltage terminal 70 and a source of an N-channel FET connected to the reference voltage terminal 71 with drains of the respective FET's being connected in common to one terminal of an associated 2R resistor in the ladder resistance network 65. Take the second order MOS FET's 74 and 75 as an example, if the frequency divider stage output $S_1$ assumes a high level voltage $V_{OH}$ which is equal to $V_{ref}1$ (voltage at the terminal 70) and a low level voltage $V_{OL}$ which is equal to $V_{ref}2$ (voltage at the terminal 71), then the MOS FET 75 is turned off and the MOS FET 74 is turned on when $S_1$ assumes the high level so that $V_{ref}2$ (low level voltage) is applied to one terminal of the 2R resistor in the resistance network 65. Conversely, when $S_1$ assumes the low level, the MOS FET 74 is turned off and MOS FET 75 is turned on so that $V_{ref}1$ (high level voltage) is applied. The same is true for $S_2$, $S_3$ and $S_4$. Accordingly, a staircase wave as shown by a solid line is produced at the output terminal 69. The waveform is expressed by the following formula;

$$V_{out} = \frac{V_{ref}1 - V_{ref}2}{2 + \frac{2R}{R_L}} \left(\tfrac{1}{8} S_1 + \tfrac{1}{4} S_2 + \tfrac{1}{2} S_3 + S_4\right) \quad (3)$$

where $S_1$, $S_2$, $S_3$, $S_4$ are either "1" or "0". In FIG. 8, it has been assumed that $V_{ref} = V_{ref}1 - V_{ref}2$.

Figure 9:
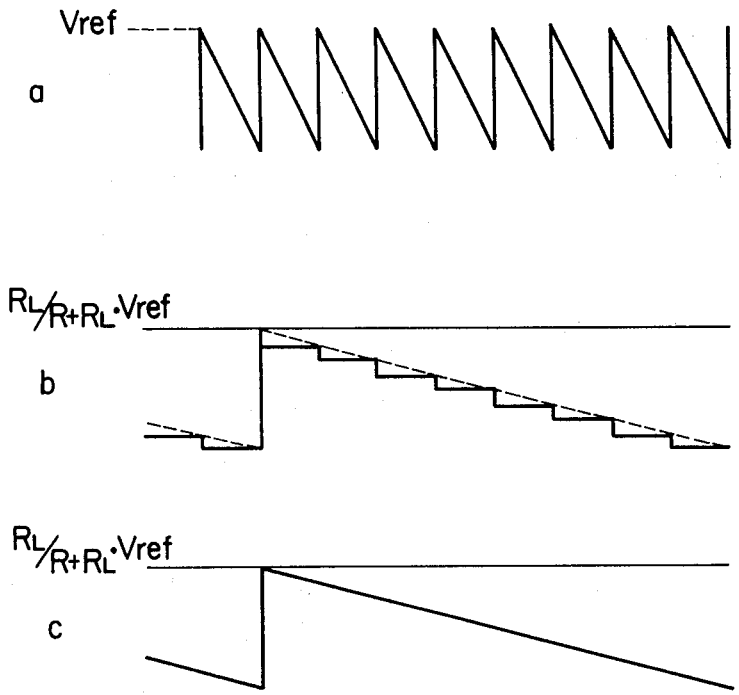
FIG. 9 shows waveforms for illustrating the operation of the circuit shown in FIG. 8.

As shown in FIG. 9(*a*), when the amplitude of the input saw-tooth wave is represented by $V_{ref}$, a saw-tooth wave having the same amplitude as the amplitude of the lowest order voltage, $$\tfrac{1}{8} \frac{V_{ref}}{2 + \frac{2R}{R_L}},$$

is added to the $V_{out}$ voltage such that it fills the steps of the staircase wave shown by the solid line in FIG. 9(*b*), in a manner as shown by the dotted line, to finally produce a saw-tooth wave shown in FIG. 9(*c*).

In the formula (3), when $R_L$ is changed from 0 to infinite, $V_{out}$ can be changed from 0 to $V_{ref}1 - V_{ref}2$. Thus, it is possible to change the amplitude of $V_{out}$ to any desired magnitude between the reference voltages $V_{ref}1$ and $V_{ref}2$ which maintaining the analogy in the waveform of $V_{out}$.

In the present embodiment, as seen from the previous description, the voltage sources for the inverter 72 and the square wave frequency dividers 61–64 are set to be equal to the reference voltages $V_{ref}1$ and $V_{ref}2$.

Figure 10:
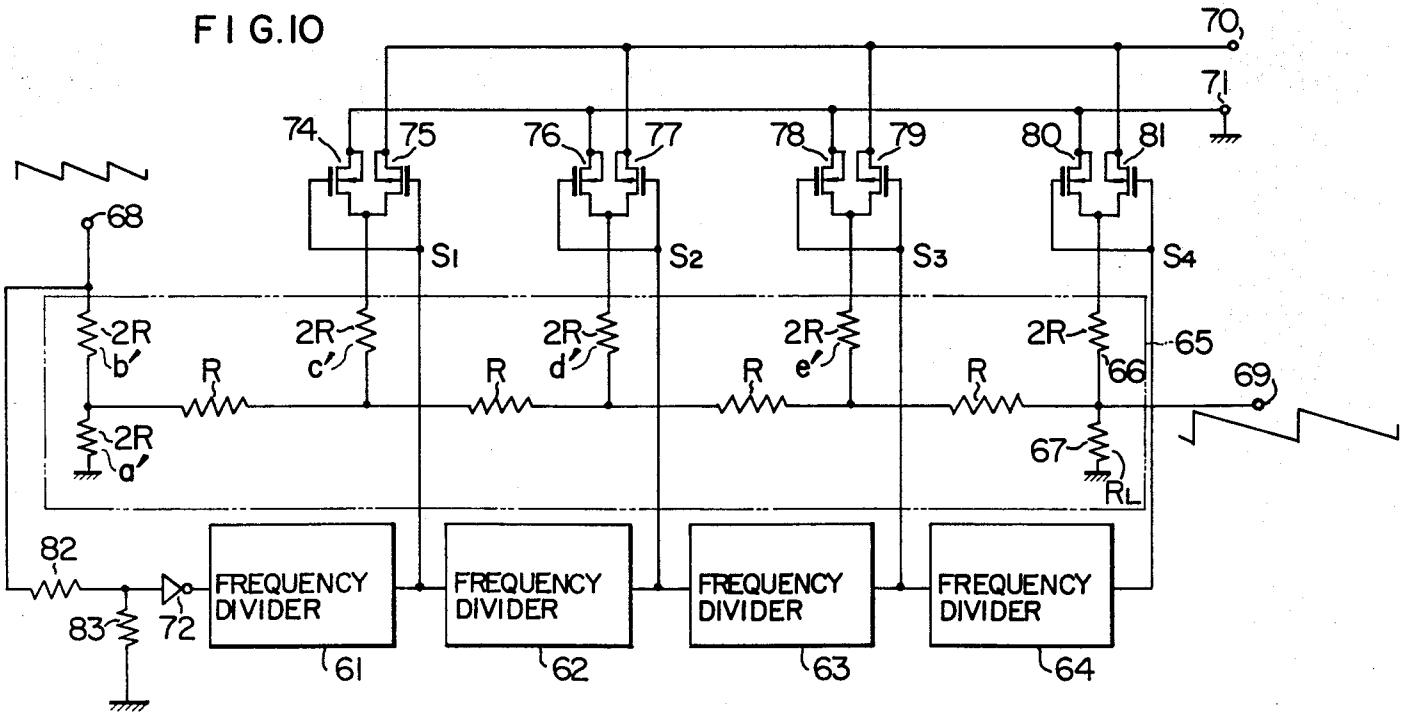
FIG. 10 is a circuit diagram of another embodiment which embodies the circuit shown in FIG. 2.

FIG. 10 shows another circuit diagram of the specific circuit. In this circuit, unlike the circuit shown in FIG. 8 the lowest order position and the second order position of the resistance network are not coupled by the parallel connection of 2R resistors but the lowest order position comprises the R-2R ladder resistace network which is a duplication for the second order position, and is terminated by 2R resistor. In this case, the voltage amplitude of the saw-tooth wave which is the input to the lowest order position is set to be equal to 2 $V_{ref}$. In this manner, the saw-tooth wave as shown in FIG. 9(*c*) is produced at the output terminal 69 in exactly the same manner as in the circuit shown in FIG. 8. The resistors 82 and 83 are dividing resistors to modify the input saw-tooth wave voltage applied to the terminal 68, which has the magnitude of 2 $V_{ref}$, to a voltage suited to the input voltage to the inverter 72.

Figure 11:
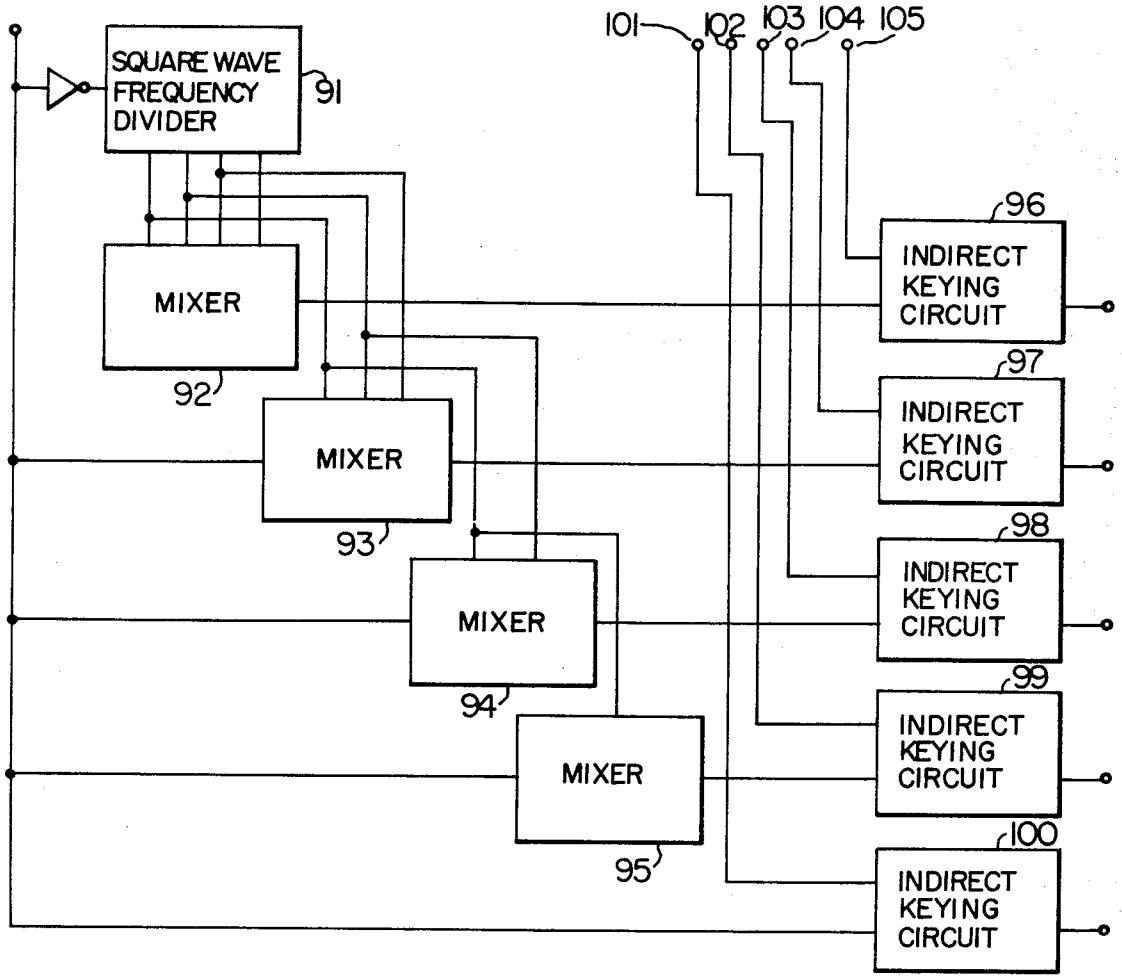
FIG. 11 is a block diagram of one embodiment illustrating the construction of a tone generator system for an electronic organ comprising a plurality of saw-tooth wave frequency dividers and an indirect keying system.

While the above description is limited to a saw-tooth wave which has a repetition frequency of 1/16 as low as that of the input saw-tooth wave, a train of saw-tooth waves each having a ½n repetition frequency can be simultaneously generated by a train of square wave frequency dividers by the arrangement shown in FIG. 11. The arrangement of FIG. 11 comprises a square wave frequency divider 91 including a chain of ½ frequency dividers, mixers 92, 93, 94, 95 each including an electronic switch consisting of complementary MOS FET's and the ladder resistance network as shown in FIG. 8, indirect keying circuits 96, 97, 98, 99, 100, and terminals 101, 102, 103, 104, 105 to which keyboard switches are connected. The embodiment of FIG. 11 is designed to generate five octaves of saw-tooth waves or staircase waves. The indirect keying circuits will be explained in detail later.

The construction and operation of the present invention has been described. The favorable characteristic of the resulting saw-tooth wave is not discussed. Firstly, since the voltage amplitude of the waveform is determined by the externally supplied reference voltage $V_{ref}$ and the resistors 2R and $R_L$, it can be stabilized in a simple way by accurately regulating the 2R and $R_L$. Secondly, regarding the waveform, a substantially perfect saw-tooth wave can be produced by establishing the ratio of the resistor R of the ladder resistance network to the on-resistance of the complementary MOS FET's of the electronic switch, to a high ratio to reduce the effect of the mismatch in the mutual conductances of the MOS FET's and by preparing the resistors of the ladder resistance network with high precision by the ion implantation technique. Thirdly, since any voltage amplitude can be selected by the selection of the terminating resistor $R_L$, a waveform which has high linearity and is free from distortion can be generated even after it has passed the indirect keying circuit consisting of enhancement type MOS FET's, because it is possible to apply to a gate of the indirect keying circuit a voltage waveform which exceeds a threshold voltage which is one of the causes of the non-linearity of the indirect keying circuit.

While the present embodiment uses complementary MOS FET's in the electronic switch, bipolar transistors may be used.

Figure 12:
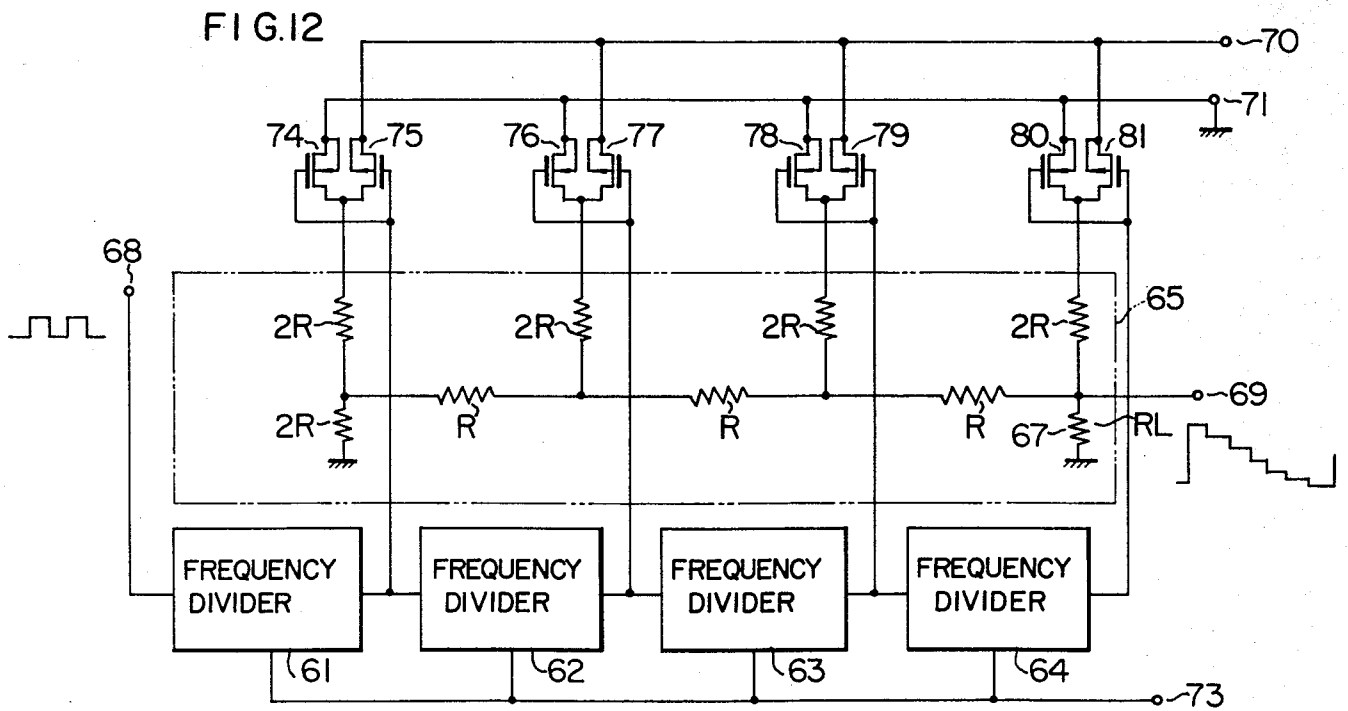
FIG. 12 is a circuit diagram illustrating an embodiment of a staircase wave frequency divider circuit when a square wave is used as an input signal in the frequency divider circuit of the present invention.
Figure 13:
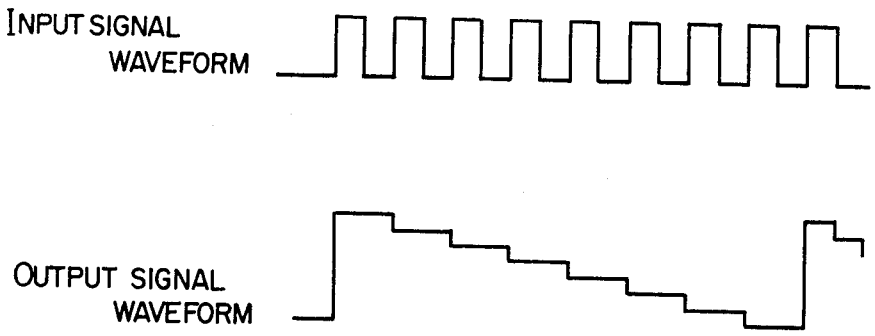
FIG. 13 shows input/output waveforms of the circuit shown in FIG. 12.

A simplified modification of the frequency divider circuit of the present invention is now described. The simplfication in this example means the use of a square wave signal as the input signal. When the square wave signal is used as the input signal, the output waveform is a staircase wave when the number of stages of the frequency division is large, and a frequency spectrum close to that of a saw-tooth wave is produced. However, when the number of stages of the frequency division is small, such as two, the frequency spectrum is considerably different from that of the saw-tooth wave. Nevertheless, the present embodiment is advantageous in that the system configuration can be simplified because a square wave or pulse may be used as the input signal. FIG. 12 shows a circuit configuration and FIG. 13 shows portions of input and output waveforms. The difference of FIG. 12 from the circuit for the saw-tooth wave or staircase wave input is that the former does not need an inverter and the frequency division ratio is reduced to one half because of the lack of the lowest order position.

Figure 14:
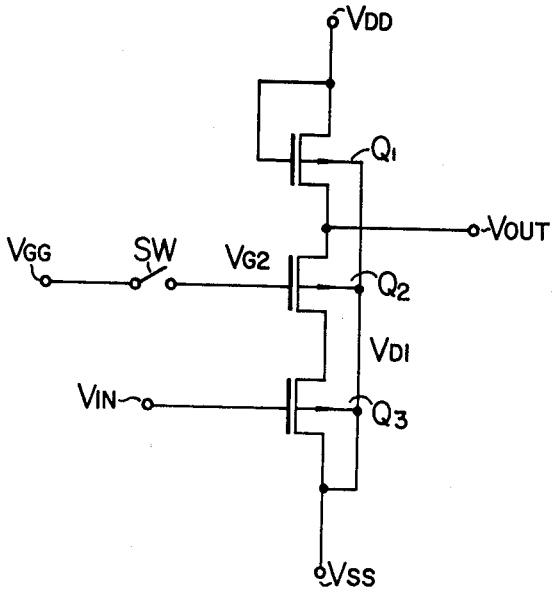
FIG. 14 is a circuit diagram illustrating one embodiment of an analog switch used as the indirect keying system in the present invention.

A second feature of the present invention relates to an analog switch having a linear transfer characteristic and a wide dynamic range for indirectly keying the saw-tooth wave or staircase wave signal frequency divided by the above frequency divider circuit, in response to the switching of a keyboard. A specific example is given below. FIG. 14 shows a first embodiment thereof.

In the drawing, while transistors $Q_1$, $Q_2$ and $Q_3$ are shown as enhancement type P-channel MOS FET's they may be N-channel MOS FET's and the same explanation is applicable. The circuit shown includes voltage supply terminals $V_{DD}$, $V_{SS}$, a terminal $V_{GG}$ to which a D.C. voltage is applied, an input terminal $V_{IN}$ to which an analog signal of a musical signal such as a saw-tooth wave is applied, an output terminal $V_{out}$, and a keyboard switch SW of an electronic organ for switching the musical signal.

The operation of the embodiment of FIG. 14 is now explained. Let us assume that in a particular example the mutual conductances and the threshold voltages of the respective field effect transistors (FET's) are equal, respectively, and the threshold voltage $V_T$ is equal to $-1$ V ($V_T=-1$ V), and $V_{DD}=-15$ V, $V_{SS}=0$ V, $V_{GG}=-15$ V. Since the drain and gate of the first FET ($Q_1$) are connected in common, the relation $|V_D|>|V_G-V_T|$ is always satisfied and $Q_1$ operates in the saturation region, where $V_D$ is the drain voltage of the MOS FET, $V_G$ is the gate voltage, and $V_T$ is the threshold voltage of a channel.

When the keyboard switch SW is closed, it follows that $V_{GG}=V_{G2}=-15$ V and the second FET ($Q_2$) is in its full conductive state. The operating region of the second FET ($Q_2$) is in a triode characteristic region or what is called a constant resistance region. That is, a voltage drop across the drain-source of the second FET ($Q_2$) is proportional to a current flowing from the terminal $V_{DD}$ to the terminal $V_{SS}$ and the magnitude thereof is determined by the signal amplitude applied to the terminal $V_{IN}$. If the voltage magnitude of an analog signal applied to the gate $D_{IN}$ of the third FET had an absolute value which is smaller than the drain voltage $V_{DI}$ of the third FET, the third FET ($Q_3$) also operates in a saturation mode like the first FET ($Q_1$). This can be readily attained when the gate voltage $V_{G2}$ of the second FET ($Q_2$) is sufficiently high and the second FET ($Q_2$) is operating in the triode characteristic region.

In the present embodiment, the input analog signal applied to the terminal $V_{IN}$ is a saw-tooth wave and the signal amplitude is $-2$ – $-5$ V.

Accordingly, with the keyboard switch (SW) being closed, the circuit arrangement is essentially equivalent to an inverter having the first FET ($Q_1$) as a load transistor and the third FET ($Q_3$) as a driving transistor. Further, since the third FET ($Q_3$) is operating in a saturation mode the input and output waveforms as shown by solid lines (a), (a') in FIG. 15 are produced, which proves a highly linear transfer characteristic.

Figure 15:
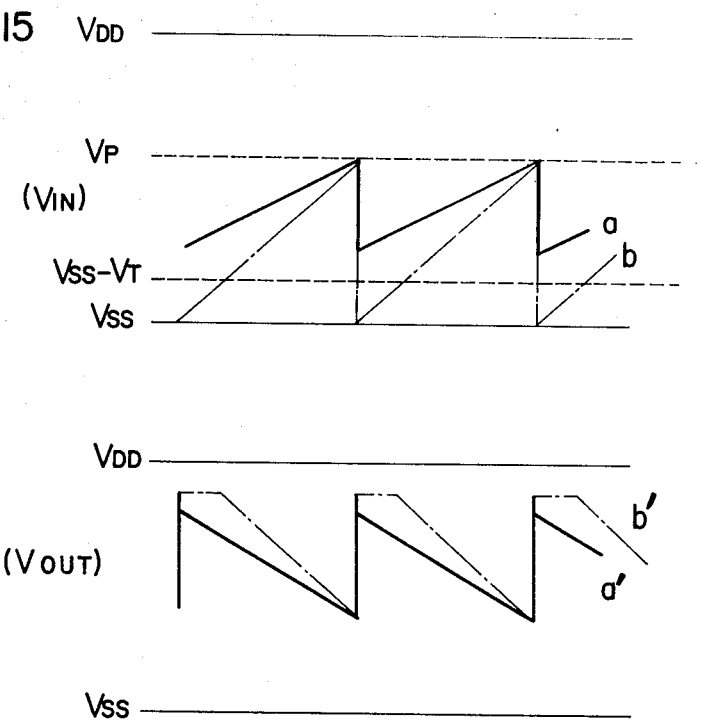
FIG. 15 shows waveforms illustrating the operation of the circuit shown in FIG. 14.

The dotted line curves (b), (b') in FIG. 15 show, for comparison purpose, input and output waveforms when peak values of the input signals are $V_{SS}$ (0 V) and $V_P$ ($-5$ V). When the input voltage is below $V_{SS}-V_T$ as shown in the drawing, the third FET ($Q_3$) is in a cut-off region and the output voltage is constant. Therefore it is desirable that the input signal not become smaller than $V_{SS}-V_T$, as in the case of FIG. 15(*a*). When the above saw-tooth wave frequency divider circuit is to be connected, the above requirement can be readily met by appropriate selection of the value of $R_L$ in FIG. 9, for example.

Figure 18:
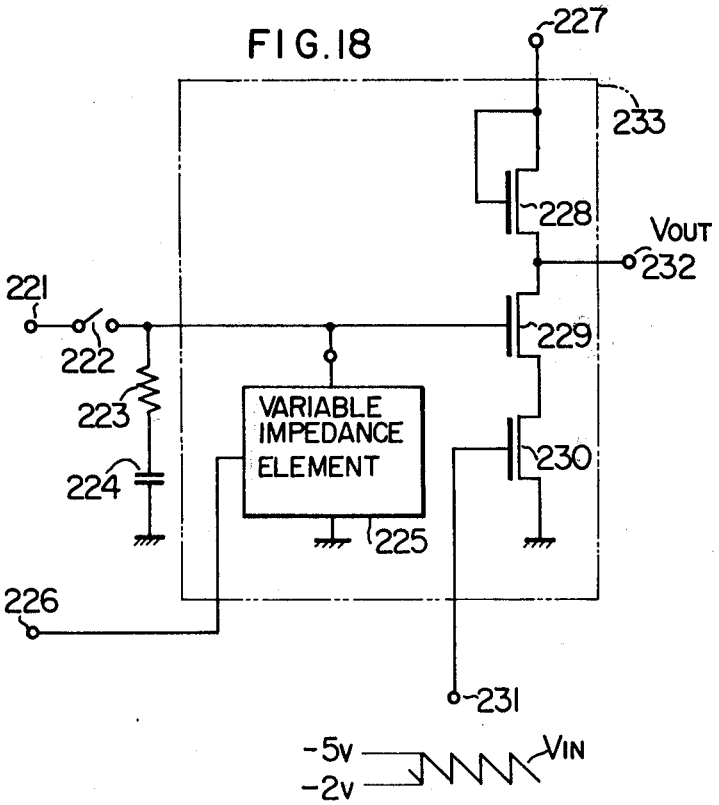
FIG. 18 is a circuit diagram illustrating the construction of one embodiment of a sustain system in which the analog switch in accordance with the second aspect of the present invention is used as the indirect keying system.

When the keyboard switch (SW) is open (it is necessary, in practice, to connect the gate of the second FET ($Q_2$) to $V_{SS}$ through an impedance 225 as shown in FIG. 18), the second FET ($Q_2$) is cut off and a voltage substantially equal to $V_{DD}$ appears at the output $V_{out}$.

In the application where the second FET ($Q_2$) is rendered fully conductive or fully nonconductive (cut-off), it is a usual practice in the electronic organ to control the rise time and fall time. Therefore, let us consider an application where the gate voltage $V_{G2}$ of the second FET ($Q_2$) in the present embodiment is varied from $V_{SS}$ to $V_{GG}$, and the resulting output waveform is discussed with reference to FIG. 18.

Figure 16:
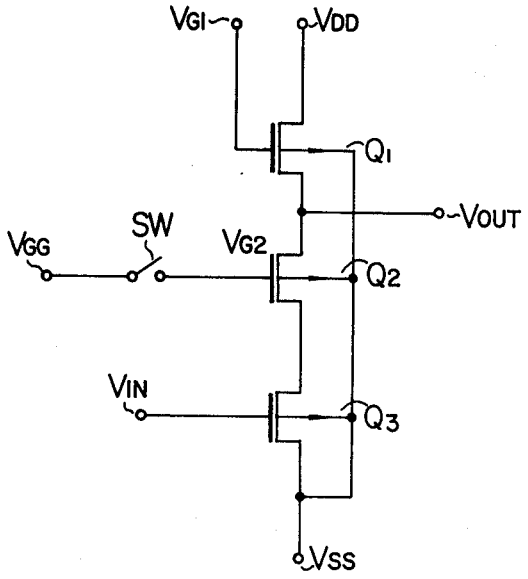
FIG. 16 is a circuit diagram of another embodiment of the analog switch of the present invention.

The circuit shown in FIG. 18 comprises a terminal 221 to be connected to a D.C. power supply, which is a $-15$ V supply in the present embodiment, a keyboard switch 222 of an electronic organ, which is closed by depressing the keyboard, resistor 223 of a low resistance value for protecting the contacts of the switch 222, a charge storing capacitor 224, an impedance element 225 for discharging the stored charge, a terminal 226 to which a control voltage is applied, a terminal 227 to be connected to the D.C. power supply, which is a $-15$ V supply in the present embodiment, transistors 228, 229, 230 which correspond to $Q_1$, $Q_2$, $Q_3$ in FIG. 16 and which are, in the present embodiment, P-channel MOS FET's, an input terminal 231 for an analog musical signal, an output terminal 232, and a circuit section 233 enclosed by a dotted line which is formed in one chip in an LSI structure. The discharging impedance element 225 need not be an impedance element having a control terminal but it may be a conventional MOS FET or resistor.

Figure 19:
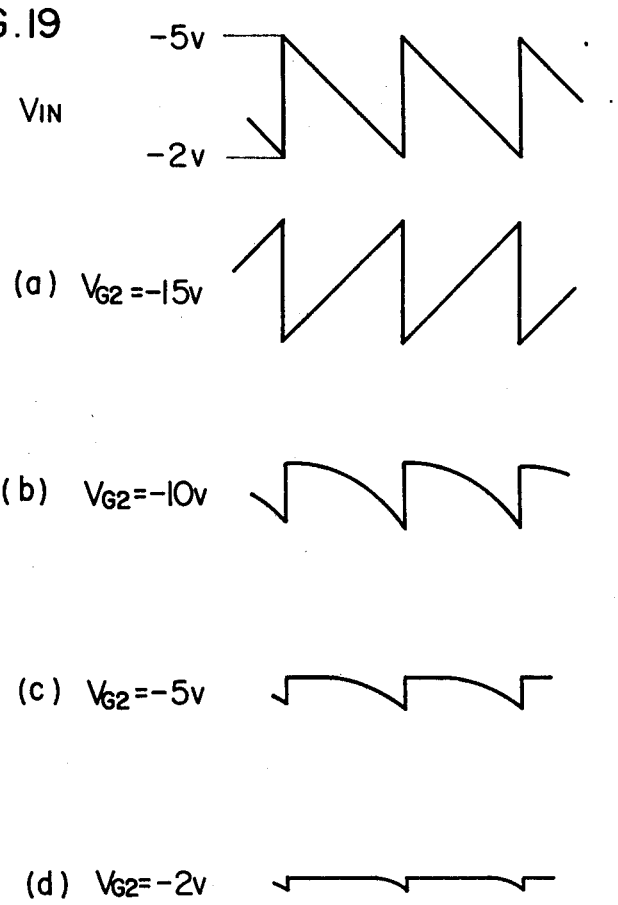
FIG. 19 shows waveforms illustrating the operation of the circuit shown in FIG. 17.
Figure 20:
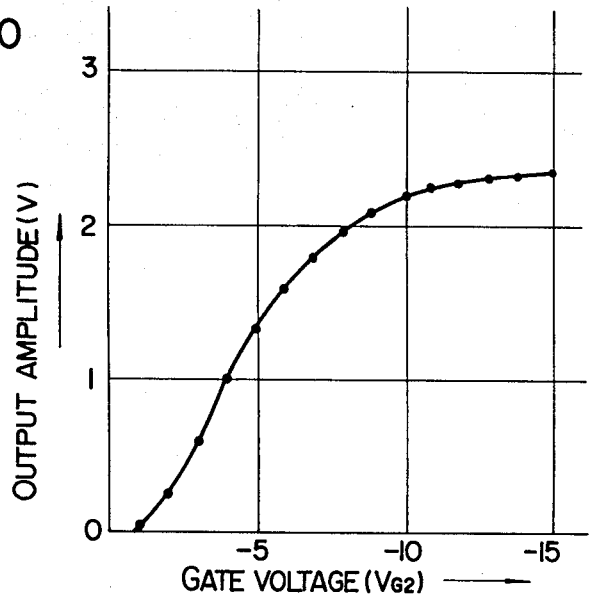
FIG. 20 shows a graph illustrating the relation between the gate voltage of transistor 229 in FIG. 18 and the output signal amplitude.

When the keyboard switch 222 is opened, the charge in the capacitor 224 gradually discharges through the impedance element 225 so that the gate potential of the transistor 229 gradually falls. The output waveform signal at the output terminal 232 when the saw-tooth analog signal $V_{IN}$ as shown in FIG. 18 is applied while changing the gate voltage of the transistor 229 is shown in FIG. 19 and the plot of the amplitude (peak-to-peak value) vs gate voltage is shown in FIG. 20. Referring to FIG. 19, as the gate voltage of the transistor 229 decreases from −14 V to −13 V, −12 V, . . . , the operation region of the transistor 229 shifts from a non-saturation region to a saturation region. The operation of the transistor 230 shifts from the saturation region to the non-saturation region at an input voltage of around −5 V where the drain voltage thereof becomes smaller. Thus, as the gate voltage of the transistor 229 decreases, the transistors 229 and 230 operate in the saturation region respectively or operate in the saturation region and non-saturation region, respectively, so that the voltage waveform at the drain of the transistor 229, i.e. the output voltage waveform at the terminal 232 changes from the shape shown in FIG. 19(*a*) to the shapes as shown in FIGS. 19(*b*), (*c*), (*d*) where peaks of the waveforms are gradually collapsed. The frequency components of the waveform includes more fundamental component content and less harmonic component content to compare with the saw-tooth wave, as the gate voltage decreases to −10 V, −5 V and −2 V. This means that at the decay of the musical signal the harmonic component rapidly attenuates and the waveform rapidly approximates a sinusoidal wave. Thus a characteristic which is very close to the decay of the natural musical instrument and which is advantageous for the musical signal is attained.

On the other hand, as seen from FIG. 20, while the output amplitude decreases with the decrease of the gate voltage, the rate of change in the output voltage to the change of the gate voltage is smaller in the gate voltage range of −15−10 V and the rate in the change of the output voltage rapidly increases as the gate voltage goes below about −10 V, presenting the so-called upwardly convex relation.

While the analog switch circuit as described above uses the first FET ($Q_1$) having its gate and drain connected in common the gate is not necessarily in common with the drain, as illustrated in a second embodiment shown in FIG. 16, and the same result as in the previous embodiment can be attained if the operation region of the first FET ($Q_1$) is in the saturation region. If the gate voltage $V_{G1}$ is set such that the first FET ($Q_1$) is operated in the non-saturation region, an output waveform as shown in FIG. 18(*b*) is produced even when the gate voltage $V_{G2}$ of the second FET ($Q_2$) is sufficiently high. This is effective in attenuating the higher order harmonic component of the output waveform below the saw-tooth wave.

Figure 17:
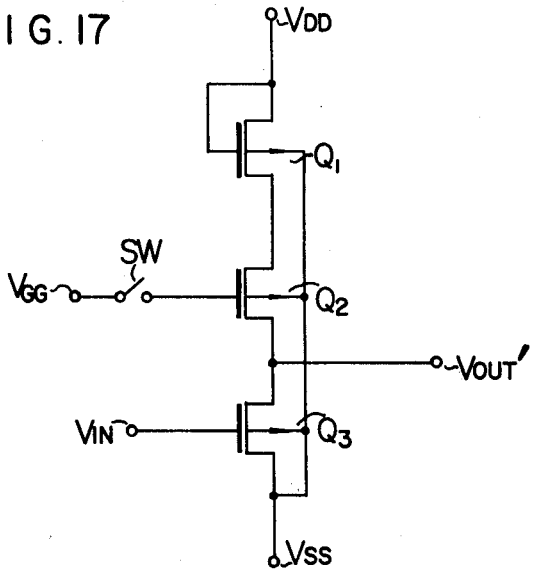
FIG. 17 is a circuit diagram of further embodiment of the analog switch of the present invention.

FIG. 17 shows a third embodiment in which the output terminal $V_{out}'$ is taken out of the drain of the third FET ($Q_3$). A D.C. level of the output waveform taken out of $V_{out}'$ considerably changes as the gate voltage of $V_{G2}$ of the second FET ($Q_2$) changes, but the output waveform after the D.C. component has been eliminated is substantially the same as that of the first embodiment (FIG. 14) and hence there is no problem.

In the embodiment shown in FIG. 16, an A.C. voltage of appropriate voltage waveform may be applied to the gate electrode ($V_{G1}$) of the first FET ($Q_1$) and the output signal may be amplitude modulated using the A.C. voltage as an amplitude control voltage. With the arrangement of FIG. 16, an advantageous feature is brought about in that the amplitude modulation which has been used in the prior art electronic organ can be attained simultaneously with the keying without requiring an additional circuit.

While the effects of the second feature of the present invention have been described above, they are summarized below.

1. A keying system of simple construction and linear transfer characteristic is attained.

2. An indirect keying system for an electronic organ which produces a spectrum envelope close to that of the natural musical instrument at the time of rise and fall is attained.

3. Since the sustain discharging element and the saw-tooth wave frequency dividers can be constructed in a monolithic structure, the construction of the electronic organ is simplified and a reliable organ system is provided.

4. The characteristics of the system do not depend on the mutual conductances of the FET's which changes from lot during manufacture to lot and the threshold voltage variation does not effect the gain or other characteristics except that the dynamic range is narrowed. Therefore the variation in the characteristic parameters of the FET's does not cause essential adverse effects.

5. The amplitude modulation which enables provision of the tremoro effect in the electronic organ can be effected simultaneously with the keying.

As described above, the analog switch of the present invention has a highly linear transfer characteristic and is readily formed into a monolithic structure and it is advantageous in use as the keying system of the electronic organ.

A sustain system, which is a third feature of the present invention, will now be explained. As shown in FIG. 18 the analog switch described above is used as the indirect keying system and the charge storing capacitor and a newly proposed discharging element are connected to the control gate to form the sustain system.

Figure 21:
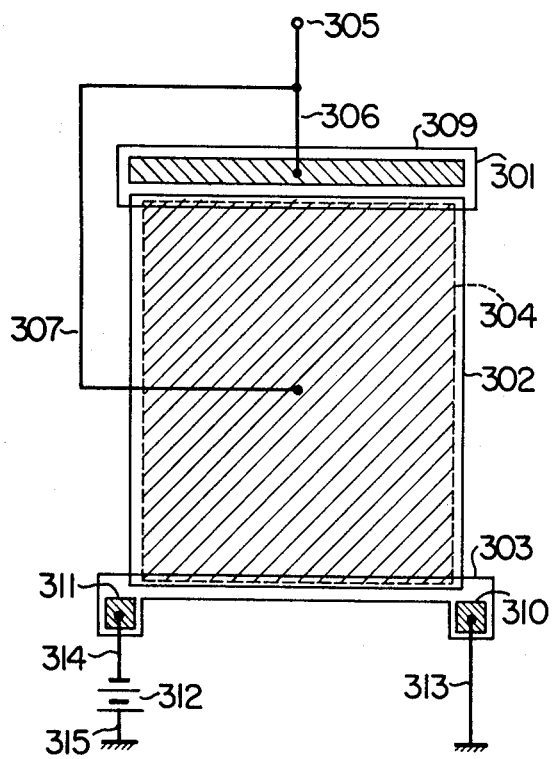
FIGS. 21 and 22 show the configuration, in plan view, of a variable impedance element used as the sustain system in the present invention.
Figure 22:
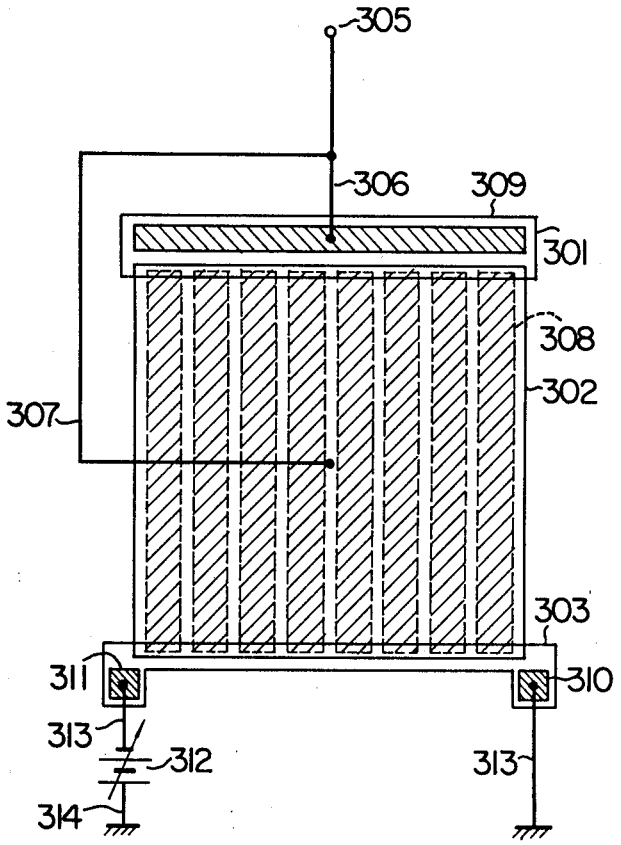
Figure 23:
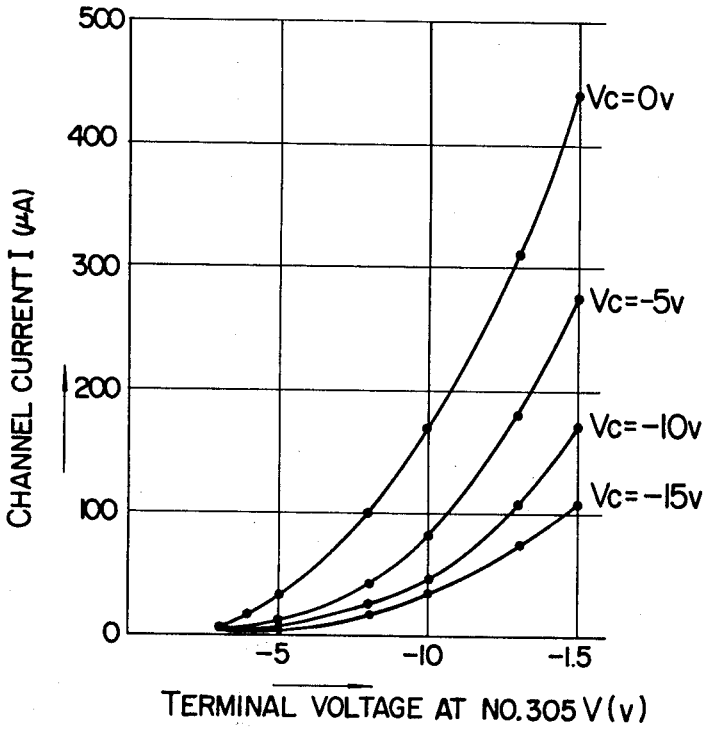
FIG. 23 shows a characteristic curve of the element shown in FIG. 22.

FIGS. 21 and 22 show square characteristic variable impedance elements which are used as the discharging element in the sustain system of the present invention, and FIG. 23 shows the characteristic thereof. The construction of FIG. 21 comprises a drain region 301 of a MOS transistor, a gate electrode 302, a source region 303, a gate cut region 304, an external terminal 305, an electrode 309 leading to the drain region 301, a lead connecting the drain electrode 309 to the external terminal 305, a lead 307 connecting the gate electrode 302 to the drain electrode 309, a first electrode 310 formed at one end of the source region 303, a second electrode 311 formed at the other end of the source region 303, a variable voltage source 312 for supplying a control voltage, a lead 313 connecting the electrode 310 to a reference voltage, and leads 314 and 315 for supplying control voltage to the electrode 311. The present element has a similar structure to that of a P-channel MOS transistor formed on an N-type substrate, and the source region 303 is constructed by a resistor and has electrode at its opposite ends, to one of which the control voltage is applied to produce a voltage gradient in the source region 303.

It is well known that a voltage-current characteristic of a two-terminal element constructed by a P-channel transistor formed in an N-type semiconductor substrate and having a gate connected to a drain is expressed by:

$$I = -\frac{\beta}{2}(V - V_T)^2 \quad (4)$$

where $V_T$ and $\beta$ are constants determined by the material and structure and are not controllable by the application of an external voltage after manufacture. The element of the present invention enables effective external electrical control of $\beta$.

In general, the characteristic formula of a MOS transistor having a potential floating from a source substrate can be expressed by substituting $V_T$ in formula (4) with $V_T+\Delta V_T$, where $\Delta V_T$ represents a substrate bias effect. Since the source-drain voltage is less by the amount of source voltage $V_S$, it is expressed by:

$$I = -\frac{\beta}{2}(V - V_S - V_T - \Delta V_T)^2 \quad (5)$$

In the P-channel MOS element of the present invention, V, $V_C$, $V_T$, $\Delta V_T$, $V_S$ are all of negative magnitude and they are;

$V=0--15$ V $V_C=0--15$ V $V_T\cong-1$ V and $\Delta V_T$ has a negative value determined by the source voltage $V_S$ and $\{\Delta V_T|$ increases as $|V_S|$ increases.

Turning to the construction of FIG. 21, the source potential varies from 0 to $V_C$, from the right to the left in the drawing. Accordingly, regarding the substrate bias effect, $|\Delta V_T|$ is maximum at the leftmost end of the source and $|\Delta V_T|\cong 0$ at the rightmost end. As also seen from formula (5), as it moves toward the left end, $|\Delta V_T|$ increases and the reduction of current increases. That is, in the construction of FIG. 21, the drain-to-source current is not uniform but smaller as it moves toward the left end. As $|V_C|$ increases the reduction of the current is remarkable more and more so that the total drain-to-source current of the present element can be controlled by changing the magnitude of $V_C$.

FIG. 22 shows another example of the square characteristic variable impedance which forms a part of the present system. Those elements having the same reference numeral as used in FIG. 21 are the same as those in FIG. 21 and are not described here. The reference numeral 308 in FIG. 22 designates a gate cut region, and unlike the embodiment shown in FIG. 21, it is constructed in a stripe form as shown in the drawing. While the channel current in the construction of FIG. 21 concentrates to the right near the source as the potential $|V_C|$ at the terminal 311 increases, the construction of FIG. 22 causes the current to flow along the stripes because the gates are arranged in stripe form and the concentration of the current near the source as encountered in FIG. 21 does not occur. As a result, the ability to control the channel current by $V_C$ has been improved over the construction of FIG. 21. FIG. 23 shows the relation between the voltage between the terminal 305 and the substrate and the channel current for the structure shown in FIG. 22 in which the gate width W and the gate length L are equal, with $V_C$ being a parameter.

As also seen from FIG. 23, the channel current I has the following relation with respect to the terminal voltage V;

$$I\cong K(V-V_T)^2 \quad (6)$$

where K is controlled by a control voltage $V_C$ and it changes by the factor of about 4 in the present example when $V_C$ is changed from 0 V to −15 V. As seen from the drawing, the elements shown in FIGS. 21 and 22 exhibit voltage-current characteristic of downwardly convex square characteristic and allow a change in K.

A sustain system of the present invention in which the elements shown in FIGS. 21 and 22 are explained with reference to FIG. 18, in which the change in the output signal with respect to the change in gate voltage $V_{G2}$ of the transistor 229 is the same as explained above. Therefore the change in time of the base voltage $V_{G2}$ of the transistor 229 is explained here. Assuming that the discharging current i through the impedance element 225 is expressed by $$i=K(V_{G2}-V_T)^2 \quad (7)$$

and the resistance of the protective resistor is sufficiently small and can be neglected, then the following relation is met;

$$-i=C\,(dV/dt) \quad (8)$$

From equations (7) and (8), and assuming that $$V_{G2}\,(t=0)=V_0 \quad (9)$$

then, $$V_{G2}(t) = V_T + \frac{1}{-\tau\,\frac{1}{V_O - V_T}} \quad (10)$$

where the normalized time $$\tau = (-\frac{K}{C})\,t \quad (11)$$

Figure 24:
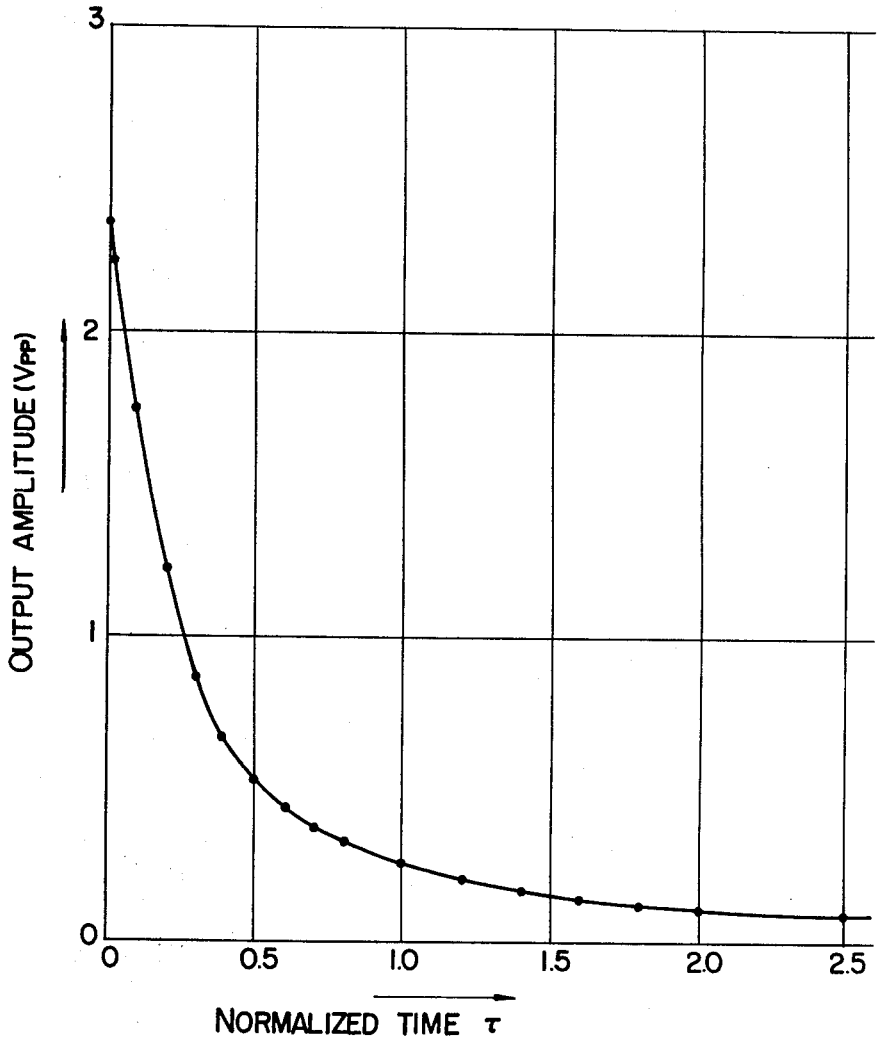
FIG. 24 shows a graph illustrating the change with time of the output signal amplitude.

Since the change in time of the base voltage of the transistor 229 is given by equations (10) and (11), the change in time of the output signal amplitude at the output terminal 232 is determined from the above result and the result of FIG. 20. One example of the result when $V_0=-15$ V is shown in FIG. 24. The attenuation curve shown in FIG. 24 is substantially exponential and tends to decay somewhat more slowly than the exponential curve at the rear half of the decay. This characteristic approximates an ideal one for the decay characteristic of a musical signal and a desired characteristic can be attained. Although the actual characteristic of the impedance element may somewhat deviate from the square characteristic shown in equation (7), the resulting deviation in the decay curve is too slight to cause a problem in listening to the sound.

While the analog switch consisting of the transistors 228, 229, 230 is used to take out the output signal from the terminal 232 in the embodiment shown in FIG. 18, the transistors 228, 229, 230 in the circuit of FIG. 18 may be replaced by one MOS transistor to form an analog switch with the elements shown in FIGS. 21 and 22 being used while presenting a decay curve which is similar to that of FIG. 23.

Figure 25:
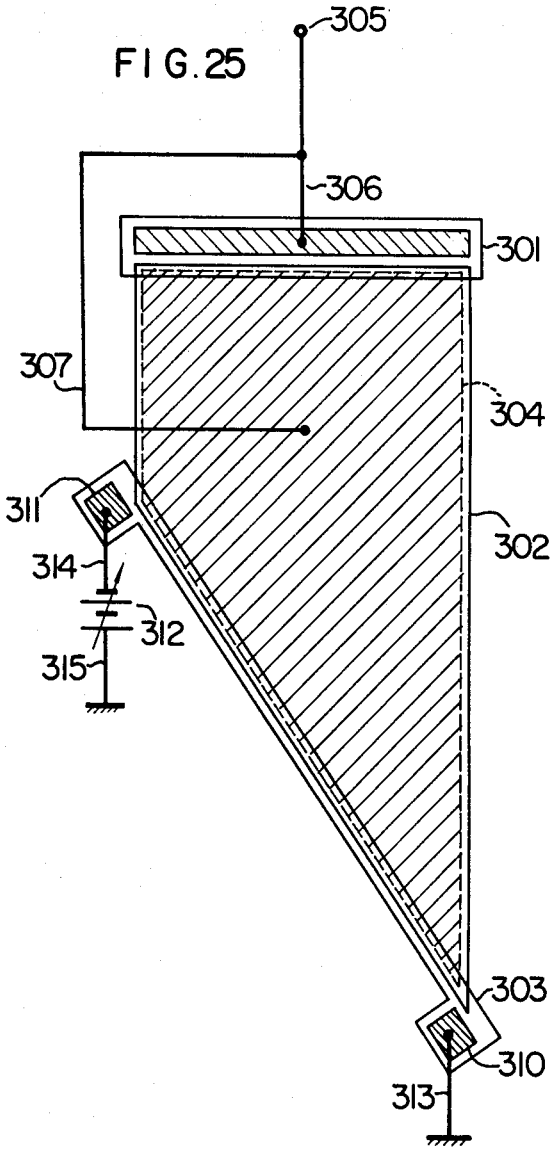
FIGS. 25 and 26 show the configuration, in plan view, of another embodiment of the variable impedance element.
Figure 26:
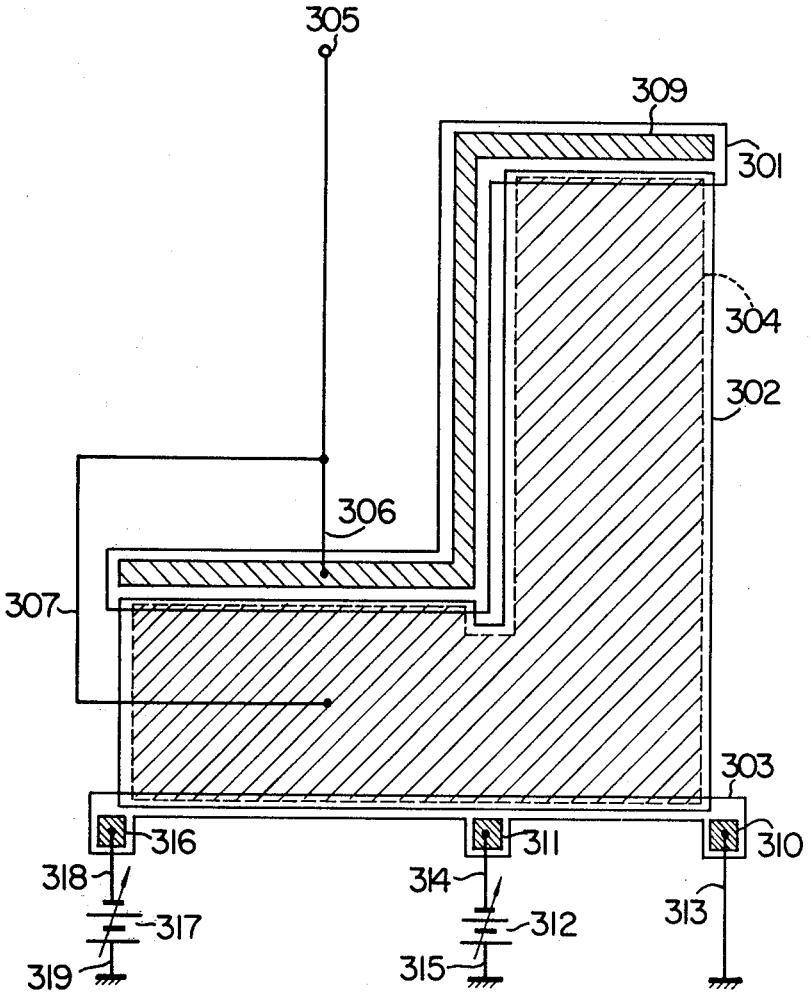

Further examples of the variable impedance element, which are different from those of FIGS. 21 and 22, are shown in FIGS. 25 and 26. The element shown in FIG. 25 has an improved ability to control the discharging current or the sustain time. The parts in FIG. 25 are the same as the correspondingly numbered parts in FIG. 21 and they are not explained here. In FIG. 25, however, the separation from the source to drain increases, from the terminal 311 to the terminal 310. When the voltage $V_C$ of the voltage source 312 is zero, the current density near the terminal 311 is high because the source-to-drain separation is small and the current density decreases as it is shifted toward the terminal 310. As $V_C$ is increased from 0 to a negative value, the current near the terminal 311 decreases, and near the terminal 310 where current is not substantially changed the current density is inherently low. Therefore the rate of the reduction of total channel current is high and hence the ability to control the channel current or the discharging current by the control voltage $V_C$ is improved over the embodiment of FIG. 21 in which the source and the drain are parallel. It should be understood that the gate region in the embodiment of FIG. 25 may be formed in the form of stripes as in the embodiment of FIG. 22.

FIG. 26 shows still another example of a variable impedance element in which those parts having the same reference number as those of FIG. 21 are the same as the corresponding parts in FIG. 21 and are not explained here. In the present embodiment, two regions having different source-to-drain separations are connected in parallel and the region having a longer source-to-drain separation has one end of the source grounded, and voltage $V_C$ is applied to the other end from the power supply 312. The region having shorter source-to-drain separation has the above voltage $V_C$ applied to one end of the source and an electrode formed on the other end thereof, to which electrode 316 a power supply 317 is connected through leads 318 and 319 to apply voltage $V_{C2}$ thereto. The operation of the element shown in FIG. 26 is as follows. When $V_C$ is fixed to zero and $V_{C2}$ is changed from zero to a negative value such as $-15$ V, and if $-15$ V is applied to the terminal 305, the current in the region having the shorter source-to-drain separation in the left half of the drawing decreases. Subsequently, when $V_C$ is gradually changed from zero to a negative value such as $-15$ V while holding $V_{C2}$, the current in the region having the shorter source-to-drain separation in the left half of the drawing further decreases until it is cut off. On the other hand, the current in the region having the longer source-to-drain separation in the right half of the drawing decreases in the same manner as explained in the example of FIG. 21. While $V_{C2}$ is first changed and subsequently $V_C$ is changed in the above explanation, many modifications may be employed depending upon the desired control characteristic such as that $V_{C2}$ and $V_C$ are rendered equal and applied with the same potential simultaneously, or that $V_{C2}$ and $V_C$ are changed while maintaining a predetermined relation therebetween. Thus, the embodiment of FIG. 26 provides an element the controllability of which can be changed by setting the source-to-drain separations of the left and right regions, the channel widths and the variable characteristics of the control voltages $V_{C2}$ and $V_C$. It should also be understood in the present embodiment that the gate region may be formed in stripes as in the example of FIG. 22, or the source-to-drain separation may be changed continuously as in the example of FIG. 25, or the combination of the above or many other modifications may be employed.

As a modification, the potential distribution of the source region 303 may be changed. In this case, the control characteristic due to the control voltage $V_C$ may be modified to compare with the element constructed as shown in FIG. 21.

As a gate electrode material for the above element, a wide range of material commonly used including a metal such as aluminum and silicon polycrystal may be used. While all gates of the above elements are connected to the drain, the connection need not be limited to the particular illustration but the gate potential may be changed while maintaining a predetermined relation between the gate potential and the drain potential.

Figure 27:
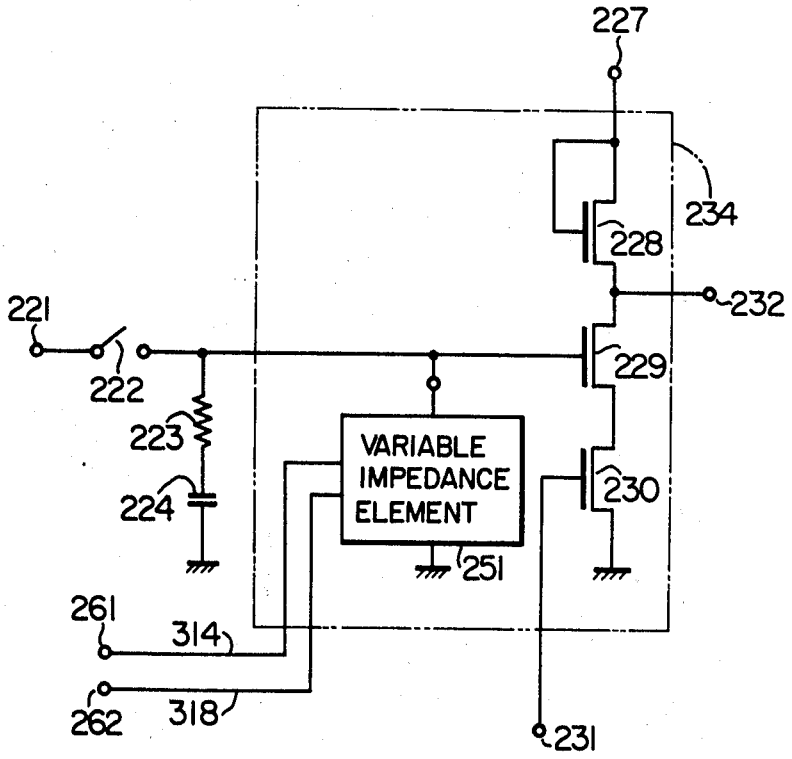
FIGS. 27, 28 and 29 show circuit configurations of other embodiments of the sustain system of the present invention.

Another embodiment of the present invention is shown in FIG. 27 in which a variable impedance element having two control terminals of the type shown in FIG. 26 is incorporated. Among the components shown in FIG. 27, those having the same reference numbers as in FIG. 18 represent the same parts as in FIG. 18 and they are not explained here. The circuit of FIG. 27 further includes a variable impedance element 251 of the type shown in FIG. 26, leads 314 and 318 which are identical to those shown in FIG. 26 and terminals 261 and 262 to which control voltages are applied. A section 234 enclosed by a dotted line shows an area which is formed in an LSI structure in one chip. The operation of the circuit of FIG. 27 is substantially the same as that of FIG. 18, and the increased freedom of control due to the provision of two control terminals has already been discussed in connection with the explanation of the operation of FIG. 26.

Where the sections 233 and 234 in FIGS. 18 and 27 are constructed in one chip, respectively, in IC or LSI structure, the gate voltage of the transistor 229 after the keyboard switch has been opened gradually decreases to $V_T$ and the transistor 229 assumes a fully cut off condition when the gate voltage reaches $V_T$. Thus, theoretically, a musical signal of a very low level is sustained for a long period. Further, depending on the nonuniformity of the threshold voltage $V_T$ in the chip, the transistor 229 might be rendered fully cut off. In order to avoid the occurrence of the above phenomenon and assure a stable operation, a high resistance may be connected in parallel with the discharging impedance element 225 or 251 respectively such that the discharge occurs mainly through the high resistance at the end of the discharge. In this case, the high resistance may be formed in the section 233 or 234 respectively or it may be externally arranged.

In order to assure stable operation, the threshold voltage of the discharging element 225 and the threshold voltage of the transistor 229 may be set differently. That is, by setting the threshold voltage of the element 225 to be smaller in absolute value than that of the transistor 229, the above trouble may be avoided. To alter the threshold voltage, many commonly known methods may be used such as that the thicknesses of the oxide films in the gate areas are altered, the types of the gate electrodes are altered, impurity concentrations in the areas immediately beneath the gates are altered by thermal diffusion process, ion implantation technique or other process, or the structures of the insulation films in the gate areas are altered to alter surface level densities, or charge densities of levels in the insulation films or traps. In order to assure such a stable operation, the threshold of the transistor 229 may be effectively increased by circuit compensation. Particular embodiments therefor are shown in FIGS. 28 and 29, in which those having the same reference numerals as in FIG. 18 are identical to those in FIG. 18 and they are not explained here.

Figure 28:
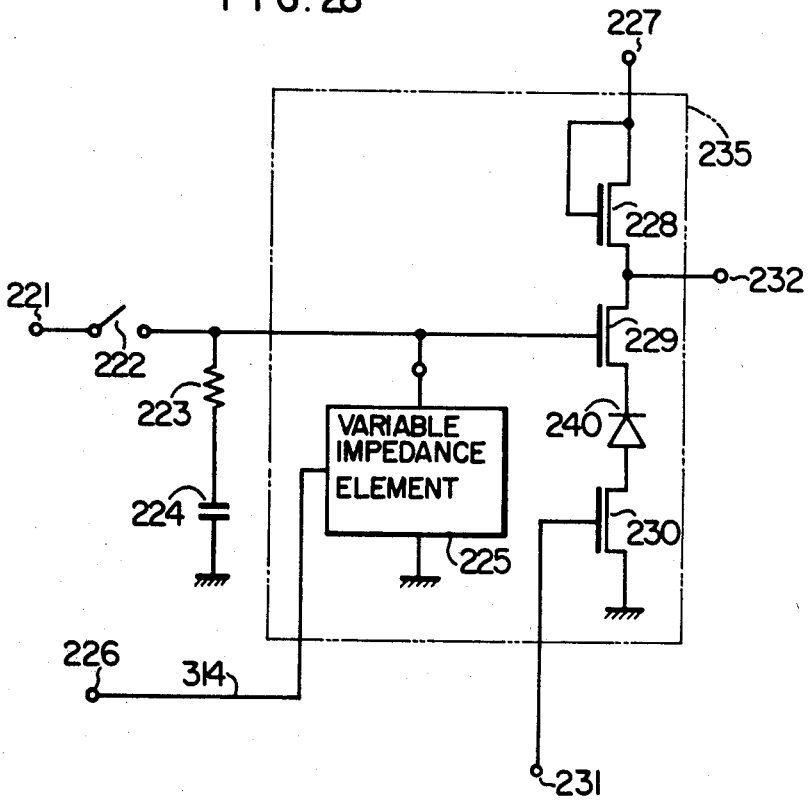

In FIG. 28, reference numeral 240 designates a level shifting diode inserted between the source of the transistor 229 and the drain of the transistor 230 to cause the cutoff voltage of the transistor 229 to be higher than the threshold voltage thereof. This diode may also be connected to the source of the transistor 230. The section 235 encircled by a dotted line represents the area which is formed in an LSI structure in one chip.

Figure 29:
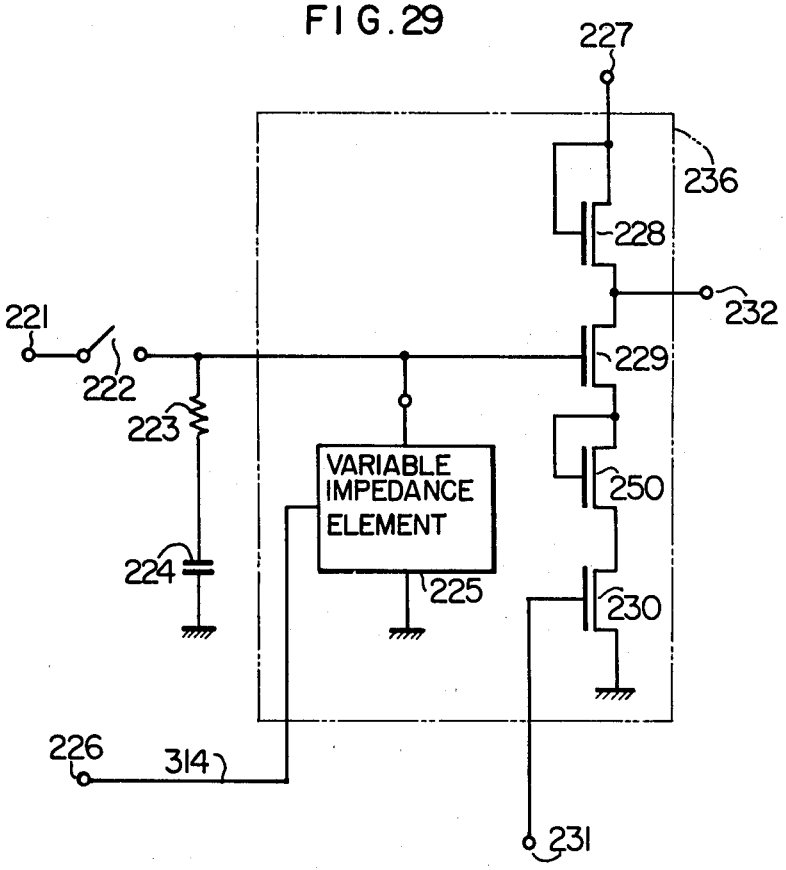

In FIG. 29, the reference numeral 250 represents a diode connected transistor for effecting a level shift. It may be inserted in the source of the transistor 230. The section 236 shows the area formed in an LSI structure in one chip.

As shown in FIGS. 28 and 29, by raising the source potential of the transistor 229, the apparent threshold voltage of the transistor 229 is increased above that of the discharging element 225 in their absolute values, whereby a stable operation is performed.

While the drain of the transistor 229 is used as the output terminal in the embodiments of FIGS. 18, 28 and 29, it should be understood that the source of the transistor 229 or the drain of the transistor 230 may be used as the output terminal.

As described above, the present invention provides advantageous features as the sustain system in an electronic musical instrument in the following aspects;

1. A sustain system of simple construction and having a natural decay envelope can be constructed.

2. The spectrum change during the sustain operation has an harmonic attenuating characteristic which is desirable in the musical signal.

3. The entire arrangement can be constructed in one chip and readily formed in an LSI structure. In this case, control terminals for the sustain time are common to respective musical signals so that the sustain effect can be enhanced by the addition of only one to two LSI pins.

In the electronic organ, the musical signals each of which has been broken by the respective keyboard switch are mixed together, passed through a filter and an effect circuit and then amplified by an amplifier and fed to a speaker. Mixing may be effected by voltage addition through mixing impedance elements as shown in FIG. 30 and this is the simplest and least expensive way.

Figure 30:
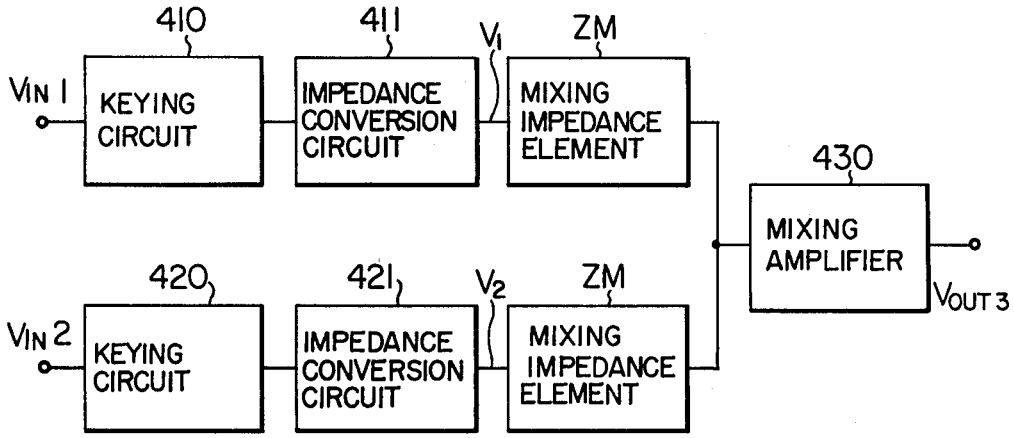
FIG. 30 shows a circuit diagram for illustrating the cross modulation by the mixing in the tone generator system of the electronic organ.

Referring to FIG. 30, the circuit comprises keying circuits 410, 420 for segmenting the musical sounds, impedance conversion circuits 411, 421, mixing impedance elements $Z_M$ and a mixing amplifier 430.

The musical signals of different frequencies applied to $V_{in\ 1}$ and $V_{in\ 2}$ are applied to the mixing impedance elements $Z_M$ through the keying circuits 410, 420 and the impedance conversion circuits 411, 421. The outputs from the impedance conversion circuits 411, 421 are taken out in the form of voltage amplitudes. Assuming that those outputs are $V_1$, $V_2$, and the output impedance of the impedance conversion circuit 411 is $Z_1$, the output impedance of the impedance conversion circuit 421 is $Z_2$ and the input impedance of the mixing amplifier 430 is infinite as an ideal case, the cross modulation increment $\Delta V_2$ to $V_1$ can be expressed by the following formula:

$$\Delta V_2 = \frac{Z_1}{2\,Z_M} \cdot V_2 \tag{12}$$

Similarly, the cross modulation increment $\Delta V_1$ to $V_2$ can be expressed by;

$$\Delta V_1 = \frac{Z_2}{2\,Z_M} \cdot V_1 \tag{13}$$

Those cross modulation increments appear in the form of differential sound in the electronic organ and bring about a deterioration of tone. Therefore they should be suppressed as much as possible. One feature of the present invention, therefore, resides in this aspect. As shown by the formulas (12) and (13), the cross modulation increments $\Delta V_1$, $\Delta V_2$ are determined by the ratio of the output impedances $Z_1$, $Z_2$ to the mixing impedance $Z_M$. Namely, a satisfactory result is obtained as the output impedances $Z_1$, $Z_2$ become smaller and the mixing impedance $Z_M$ becomes larger. Actually, however, the input impedance of the mixing amplifier 430 is not infinite and when the mixing impedance $Z_M$ becomes sufficiently high it cannot be neglected. Therefore it is desirable that the output impedances $Z_1$, $Z_2$ be as small as possible.

Figure 32:
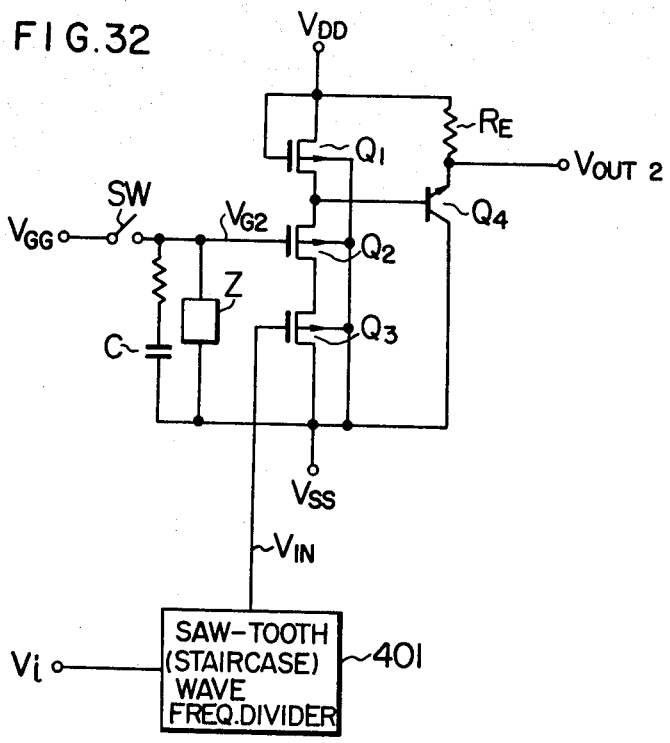
FIG. 32 shows a circuit configuration in which the sustain system and the saw-tooth wave (or staircase wave) frequency divider circuit are connected to the circuit shown in FIG. 31.

According to the present invention, in addition to the reduction of the output impedance as described above, the impedance conversion circuit which allows the fabrication of the indirect keying section and the saw-tooth (staircase) wave frequency divider section shown in FIG. 32 in a monolithic structure is connected to the indirect keying section, whereby a low impedance of the indirect keying system is attained.

Figure 31:
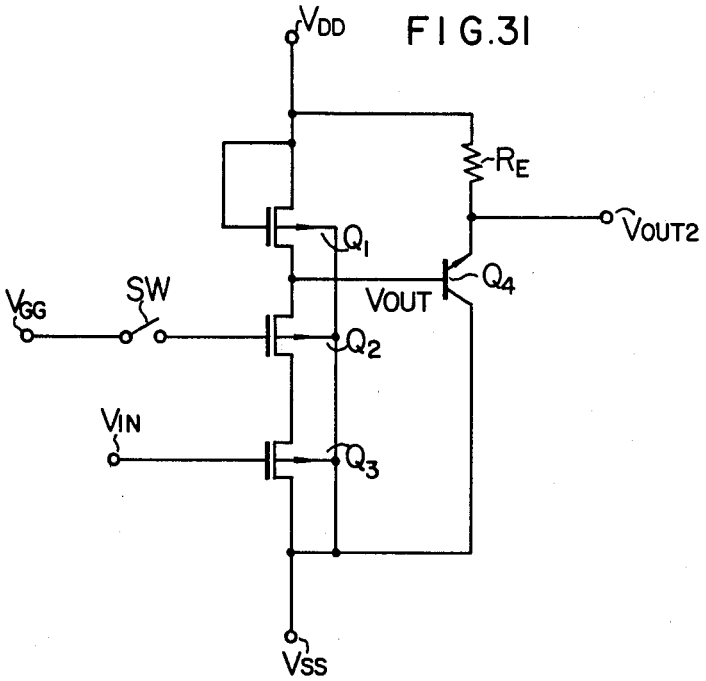
FIG. 31 is a circuit diagram of one embodiment of a low impedance analog switch of the present invention.

An embodiment in accordance with the above concept is shown in FIG. 31, the operation of which is given below.

In the drawing, $Q_1$, $Q_2$, $Q_3$, $V_{DD}$, $V_{GG}$, $V_{SS}$, $V_{IN}$, SW, $V_{out}$ are similar to those shown in FIG. 14, and an NPN transistor ($Q_4$) and an emitter serial resistor ($R_3$) are slowly added. The present configuration is a so-called emitter follower configuration and an output impedance thereof can be expressed by:

$$Z_{out} = r_e + \frac{r_{bb'} + Z_O}{1 + \beta} \tag{14}$$

where $Z_{out}$: output impedance of the transistor $Q_4$ $r_e$: emitter resistance of the transistor $Q_4$ $r_{bb'}$: base resistance of the transistor $Q_4$ $\beta$: current amplification factor of the transistor $Q_4$ $Z_0$: output impedance of the indirect keying section constituted by $Q_1$, $Q_2$, $Q_3$.

As a specific example, let us assume that the mutual conductances of the MOS FET's $Q_1$, $Q_2$, $Q_3$ are 1 m℧/V and other constants are the same as those explained in connection with the example of FIG. 14. In this case the output impedance $Z_0$ of the keying section is in the order of 1 KΩ at maximum.

The transistor $Q_4$ is constructed in a monolithic structure together with the saw-tooth wave frequency divider circuit and the indirect keying section, using a complementary MOS FET manufacturing process, in which a base is formed by a P-type well, a collector is formed by an N-type substrate and an emitter is formed simultaneously with the source and drain of an N-channel MOS FET. Assuming that the base resistance and the current amplification factor of the transistor $Q_4$ thus formed are $r_{bb}'=1$ KΩ and $\beta=100$, respectively and the emitter resistance is $r_e=25$ Ω, then the output impedance $Z_{out}$ is about 45 Ω. Thus, from the equations (12) and (13), under the condition of $Z_M=225$ KΩ, the cross modulation increment to the signal is −80 dB. It is also possible to construct the transistor $Q_4$ in a Darlington configuration to increase the current amplification factor $\beta$. Assuming that the current amplification in this case is $\beta=2000$, then $Z_{out}\simeq 26$ Ω is attained and −80 dB cross modulation is attained under the condition of $Z_M=130$ KΩ. The waveform produced at the output terminal $V_{out\,2}$ is similar to the $V_{out}$ shown in FIGS. 15 and 19 except for a D.C. level shift corresponding to the base-to-emitter voltage drop of the transistor $Q_4$.

In this manner it is possible to reduce the output impedance while keeping the output waveform unchanged.

FIG. 32 shows a configuration in which the indirect keying section having the above impedance conversion section connected thereto, the sustain effect circuit and the saw-tooth (staircase) wave frequency divider circuit are connected. The configuration of FIG. 32 is equivalent to that of FIG. 18 to which the emitter follower transistor $Q_4$ and the resistor $R_E$ are added.

The circuit configuration described above in which the emitter follower circuit is added to reduce the output impedance of the analog switch may be included in the above second feature of the present invention, and in addition to the effects described above the following effect is expected. That is, since an output signal of low impedance is produced the cross modulation among the sounds (which appears in the form of so-called differential sound) can be reduced and a musical signal of high quality of tone is produced.

While the main construction of the present invention has been described in connection with the first, second and third features, it is a fourth feature of the present invention that all of the above components can be constructed into a monolithic LSI structure, as frequently pointed out above, and the manufacturing process may be a conventional complementary MOS IC manufacturing process, provided that the charging capacitor is arranged externally, as shown in FIG. 18.

For example, in FIGS. 18 and 32, the inverter 72, the frequency dividers 61, 62, 63, 64 and the discharging impedance element Z can be constructed by P-channel MOS FET's or N-channel MOS FET's or complementary MOS FET's. Thus by constructing the ladder resistance network by a P-type well of the complementary MOS FET or by polycrystalline silicon and constructing the transistor $Q_4$ to have a collector consisting of a substrate, all of the components can be formed in a monolithic structure as seen from a sectional view of the chip show in FIG. 33.

Figure 33:
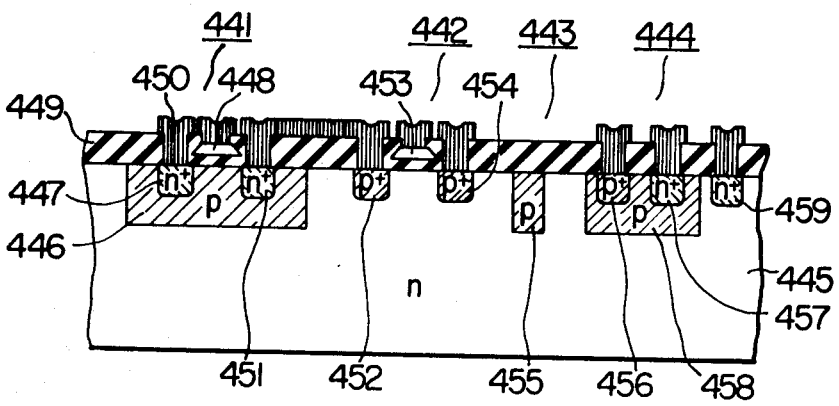
FIG. 33 shows the configuration, in section, of a portion of a semiconductor device of one embodiment of the present invention.

FIG. 33 shows the sectional view of the chip manufactured the by usual silicon gate complementary MOS FET manufacturing process. While a polycrystalline silicon gate is used as the gate of the MOS FET in the illustrated example, an aluminum gate MOS FET may also be used.

The structure shown in the drawing comprises an N-channel MOS FET 441, a P-channel MOS FET 442, a resistor 443 and an NPN transistor 444. The above elements comprises an N-type semiconductor substrate 445, P-type wells 446, 455, 458 formed by the ion implantation technique, P+ diffusion layers 452, 454, 456 having higher impurity concentrations than in the P-type wells, N+ diffusion layers 447, 451, 457, 459 having higher impurity concentrations than in the N-type substrate, an insulation layer 449, an N-doped polycrystalline silicon 448, a P-doped polycrystalline silicon 453, and a metal electrode 450.

More particularly, in the N-channel MOS FET 441, the N+ diffusion layers 447 and 451 serve as source and drain, respectively, and the polycrystalline silicon 448 forms a gate electrode. In the P-channel MOS FET, the P+ diffusion layers 452 and 454 form drain and source, respectively, and the polycrystalline silicon 453 forms a gate electrode. The P-type well 455 forms a resistor of the ladder resistance network. In the NPN transistor 444, a collector is formed by the N-type substrate 445, and the P-type well 458 forms a base region, the N+ diffusion layer 457 in the P-type well 458 forms an emitter region, the P+ diffusion layer 456 forms a low resistance region on which an electrode to the base region is formed, and the N+ diffusion layer 459 forms a low resistance region on which an electrode to the collector region is formed. In the drawing, while the drain 451 of the N-channel MOS FET 441 and the source 452 of the P-channel MOS FET 442 are connected by the metal electrode 450 to form a complementary MOS FET, it should be understood that $Q_1$, $Q_2$, $Q_3$ may be formed only by P-channel MOS FET's.

The fourth feature of the present invention provide a high performance impedance conversion system which can be constructed in a monolithic structure with the saw-tooth wave or staircase wave frequency divider circuit of the first feature of the present invention.

When it is desired to process the output signal from the saw-tooth wave frequency divider circuit without using the indirect keying system of the second feature of the present invention, it is a problem that the output impedance of the saw-tooth wave frequency divider circuit is high. Further, when the saw-tooth wave or staircase wave signal which has once been frequency divided by a first frequency divider circuit is to be applied to a second frequency divider circuit while applying the input signal applied to the first frequency divider circuit to the second frequency divider circuit in parallel, it is necessary that the output signal level and the amplitude of the first frequency divider circuit are equal to those of the input signal. In this case it is not possible to use an emitter follower circuit as an impedance converter for reducing the output impedance of the first frequency divider circuit because the emitter follower circuit necessarily results in a D.C. level shift. It is thus required to provide an impedance converter which is free from D.C. level shift.

Figure 34:
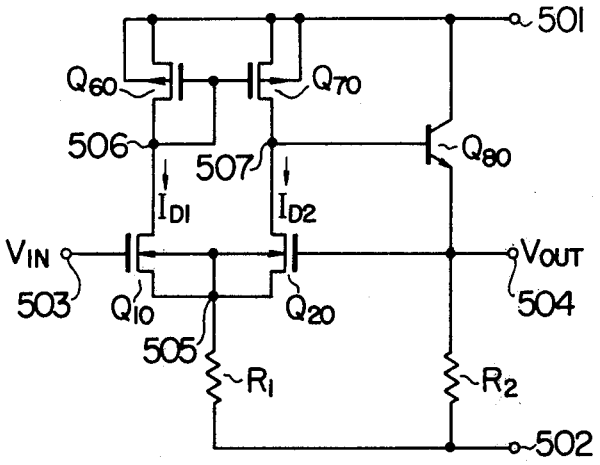
FIG. 34 is a circuit diagram showing one embodiment of the impedance converter circuit used in the present invention.

One embodiment of the present invention is now explained with reference to the drawing. FIG. 34 shows an impedance conversion circuit in accordance with one embodiment of the present invention. It comprises a positive power supply terminal 501, a negative power supply terminal 502, an input terminal 503, an output terminal 504, N-channel MOS FET's $Q_{10}$, $Q_{20}$ each formed, for example, by using a P-type well formed in an N-type substrate, P-channel FET $Q_{60}$, $Q_{70}$, a vertical NPN transistor $Q_{80}$ having a collector of the N-type substrate, a base of a P-type well and an emitter of an N+ diffusion layer formed in said P-type well, and resistors $R_1$, $R_2$ made of P-type wells, which may also be polycrystalline silicon in the silicon gate process. Now assume that the voltage $V_{IN}$ at the input terminal 503 is equal to the voltage $V_{OUT}$ at the output terminal 504. When $V_{IN}$ subsequently becomes higher, the drain current $I_{D1}$ of the FET $Q_{10}$ tends to increase while the drain current $I_{D2}$ of the FET $Q_{20}$ tends to decrease. Since the FET $Q_{60}$, $Q_{70}$ which forms a load to the differential amplifier form a current mirror circuit, no substantial change in current occurs and the voltages at the terminals 506 and 507 change to balance the circuit. In this case, the terminal 507 rises and the output terminal $V_{OUT}$ also rises. When the voltage $V_{OUT}$ at the terminal 504 reaches a voltage approximately equal to $V_{IN}$, the voltage rise at the terminals 507 and 504 stops and the condition of $V_{OUT} \approx V_{IN}$ is attained, at which the circuit stabilizes. The impedance looking from the input terminal 503 is higher than 100 MΩ because only the gate of the MOS FET $Q_{10}$ is connected thereto. Conversely, the output impedance is less than 1 KΩ because the output terminal 504 is connected to the emitter follower circuit of the transistor $Q_{80}$.

Figure 35:
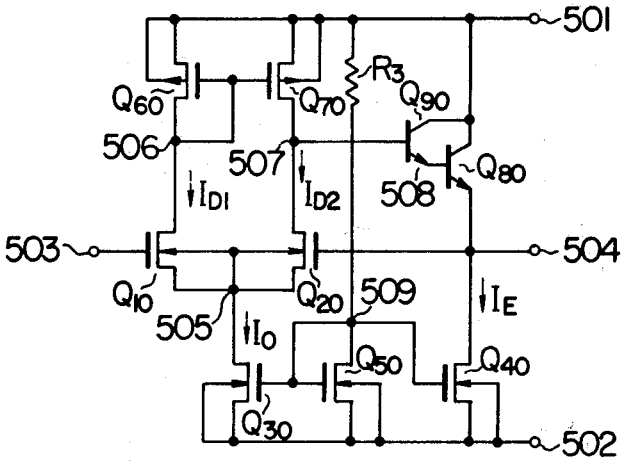
FIGS. 35, 36, 37, 38, 39, 40 and 41 are circuit diagrams showing other embodiments of the impedance converter circuit.

FIG. 35 shows another embodiment of the impedance conversion circuit in which a Darlington configuration is used in the output stage. That is, the output emitter follower comprises the Darlington configuration of the transistors $Q_{80}$ and $Q_{90}$. In FIG. 35, the resistors $R_1$ and $R_2$ in FIG. 34 are replaced by N-channel MOS transistors $Q_{30}$, $Q_{40}$, $Q_{50}$ to form a constant current circuit. The operation of the circuit is similar to that of FIG. 34, but in FIG. 35 since the sum of the currents through the FET's $Q_{10}$, $Q_{20}$ is kept constant, i.e., $I_{D1}+I_{D2}=I_0$ (constant) where $I_0$ is a current through the FET $Q_{30}$, provided that $Q_{30}$ is not in a non-saturation condition, $Q_{10}$, $Q_{20}$, $Q_{60}$, $Q_{70}$ operate with substantially constant drain current in spite of the change in the magnitude of $V_{IN}$. Therefore, an output having a wide dynamic range and a low distortion is produced. The same is true for the FET $Q_{40}$. By increasing the drain current $I_E$ of $Q_{40}$, it is possible to improve the fall characteristic. The resistor $R_3$ and the FET $Q_{50}$ form a biasing circuit to determine $I_O$ and $I_E$. In a vertical NPN transistor manufactured by conventional complementary MOS process, a D.C. current amplification factor $h_{FE}$ is in the order of 100–1000, and the experiment showed that an output impedance of less than 100 Ω was attained in the circuit of FIG. 35 having one stage of emitter follower. Depending on the load condition of the next stage to be connected to the output terminal 504, the Darlington connection may be used to further reduce the output impedance.

Figure 36:
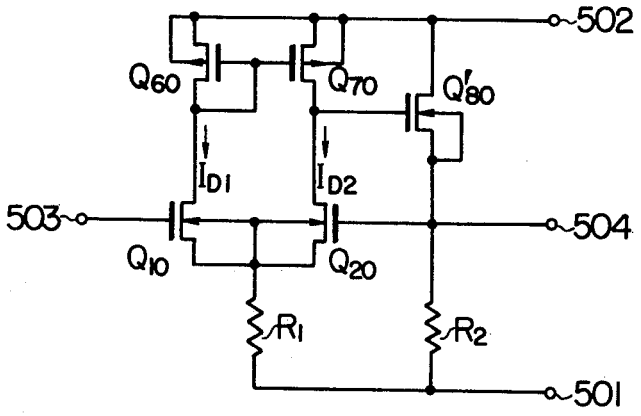

In FIG. 36, the output emitter follower $Q_{80}$ in FIG. 34 has been replaced by a source follower of an N-channel MOS FET $Q'_{80}$. In this case, the gm of the FET $Q_{70}$ can be reduced, to compare with the bipolar transistor embodiment, because no base current flows. This means that the space required for the element can be reduced, or for a given element space higher gain of the differential amplifier is attained. As the gain increases, error between the input and output reduces.

In the embodiments shown in FIGS. 34, 35, 36, the output voltage $V_{OUT}$ can be expressed by;

$$V_{OUT}=V_{IN}-V_{GS1}+V_{GS2} \quad (15)$$

where $V_{GS1}$: gate-source voltage of the FET $Q_{10}$ $V_{GS2}$: gate-source voltage of the FET $Q_{20}$ Thus, as the change in $I_{D1}$ becomes smaller, the difference between $V_{GS1}$ and $V_{GS2}$ decreases. It is therefore desirable to use the FET's $Q_{10}$ and $Q_{20}$ having as high a mutual conductance gm as possible. Stated another way, as the gain of the differential amplifier increases, the difference between the input and output decreases. The gain A of the differential amplifier can be given by;

$$A=20 \log \{gm \cdot R_D\}[db] \quad (16)$$

where gm is the mutual conductance for the FET's $Q_{10}$ and $Q_{20}$, and $R_D$ is the drain saturation resistance of the FET $Q_{70}$. If the current $I_0$ is fixed, gm of the FET's $Q_1$ and $Q_2$ is proportional to the conduction coefficient $\beta$, and $R_D$ of the FET $Q_{70}$ is also substantially proportional to the conduction coefficient $\beta$. Therefore, in order to eliminate the error between the input and output, which is one of the object of the present circuit, it is better to increase the conduction coefficient $\beta$ for the FET's $Q_{10}$, $Q_{20}$, $Q_{60}$, $Q_{70}$.

Figure 37:
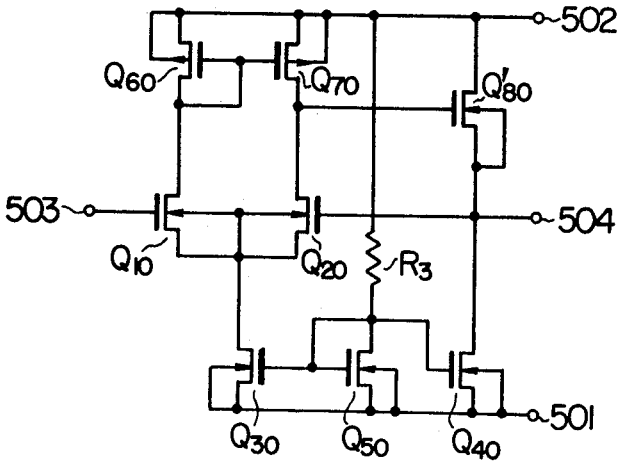

FIG. 37 shows another embodiment in which a source follower is used in place of the Darlington output stage of FIG. 35.

Figure 38:
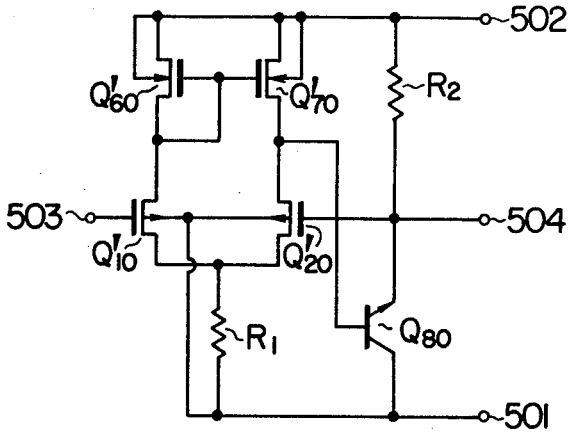
Figure 39:
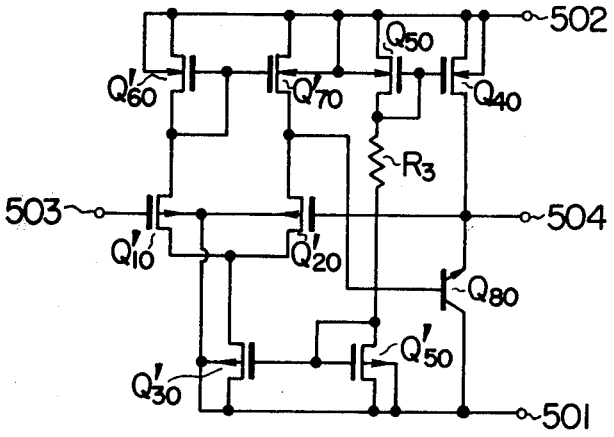

In the above four embodiments, N-channel transistors are used in the differential amplifiers. They may be replaced by P-channel transistors while simultaneously replacing the positive power supplies and negative power supplies with negative and positive power supplies, respectively. Such embodiments are shown in FIGS. 38 and 39, in which back gates of P-channel FET's $Q'_{10}$, $Q'_{20}$ are connected to a substrate. When the source is floating from the substrate as in these embodiments, an apparent $V_T$ increases and the dynamic range is narrowed. It should be understood that $Q'_{10}$ and $Q'_{20}$ may be formed in wells as in the examples of FIGS. 34, 35 and the back gates may be connected to the respective sources. In FIG. 39, the resistors $R_1$, $R_2$ in FIG. 38 have been replaced by $Q'_{30}$ and $Q_{40}$. FIGS. 38 and 39 may use the source followers in place of the emitter followers, like in FIGS. 36 and 37.

The FET's and the bipolar transistors used in the above circuits are all operated in their saturation regions. Thus, by using as high voltage supply as is allowed from the standpoint of breakdown voltage, a wider dynamic range is obtained. Further, all of the components can be manufactured by conventional complementary MOS process.

As a modification, a resistor load may be used in place of the constant current load for the differential amplifier. In this case there is a drawback in that the accuracy is lower than that obtained by the constant current load and the dynamic range is narrower but on the other hand there is an advantage in that the circuit is simplified and chip space in manufacturing in an IC structure can be reduced.

Figure 40:
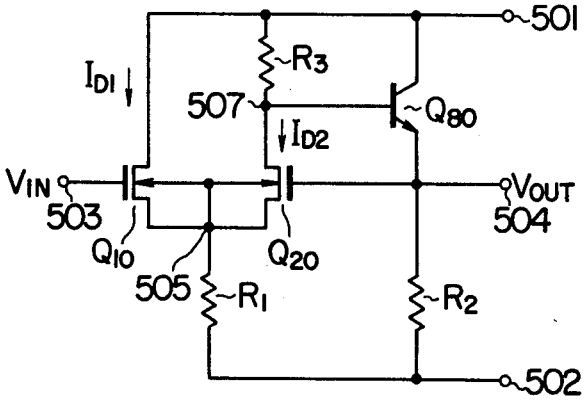
Figure 41:
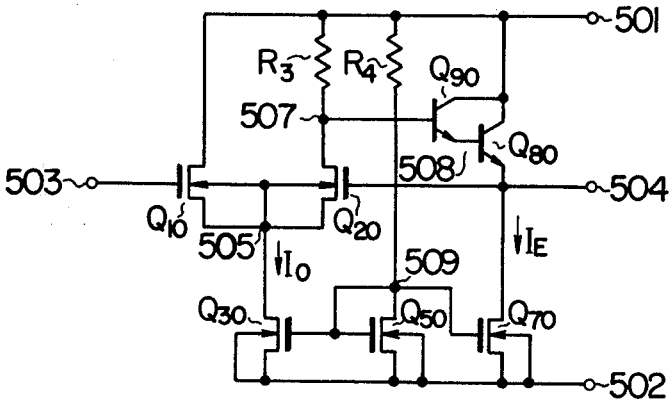

FIGS. 40 and 41 show embodiments therefor, in which the constant current loads in FIGS. 34 and 35, respectively, have been replaced by resistance loads. It is, of course, possible to replace the constant current loads in FIGS. 36–39 with resistor loads.

All of the above circuits can be readily implemented into the structure shown in FIG. 33.

In the impedance conversion circuits described above, it is easy to attain an input impedance higher than 100 MΩ and an output impedance lower than 1 KΩ, and a voltage gain substantially equal to unity. Thus, those sections of D/A converter or output circuit which have been constructed by bipolar transistors in the past, such as the circuit to digitally process the analog signal or to generate an analog signal by digital control, can be formed in one chip with the MOS IC technique. Further, since the present invention uses the complementary MOS IC process, the analog switching circuit can be manufactured simultaneously. Thus, when the present circuit is included in an input stage of an A/D converter and arranged in a stage preceding a sampling circuit, an operational amplifier need not be externally connected and the entire A/D converter can be integrated in one chip. Furthermore, since the present circuit can be considered as an operational amplifier having a high input impedance, it is an ideal element for the circuit to process a relatively large signal with a high impedance, such as a CCD or BBD circuit.

Figure 42:
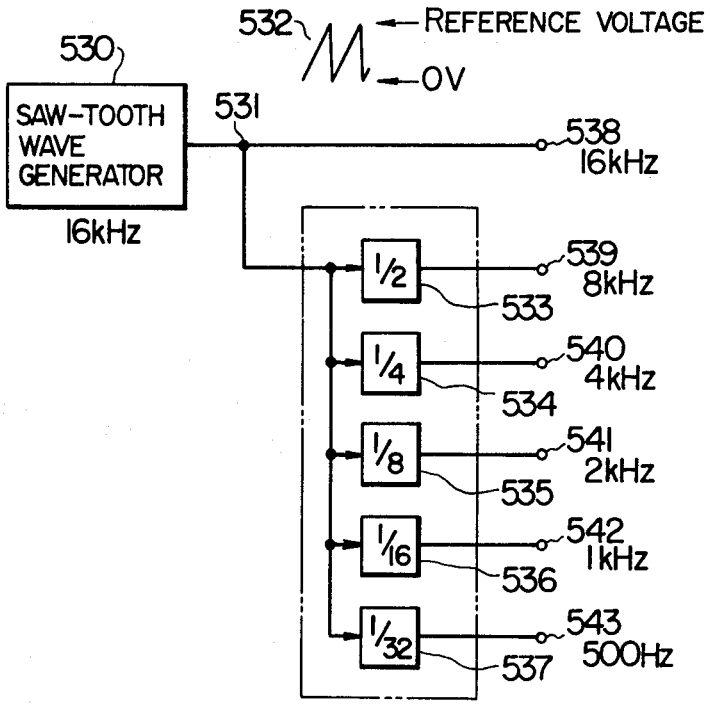
FIG. 42 shows one configuration of the tone generator system of the electronic organ.
Figure 43:
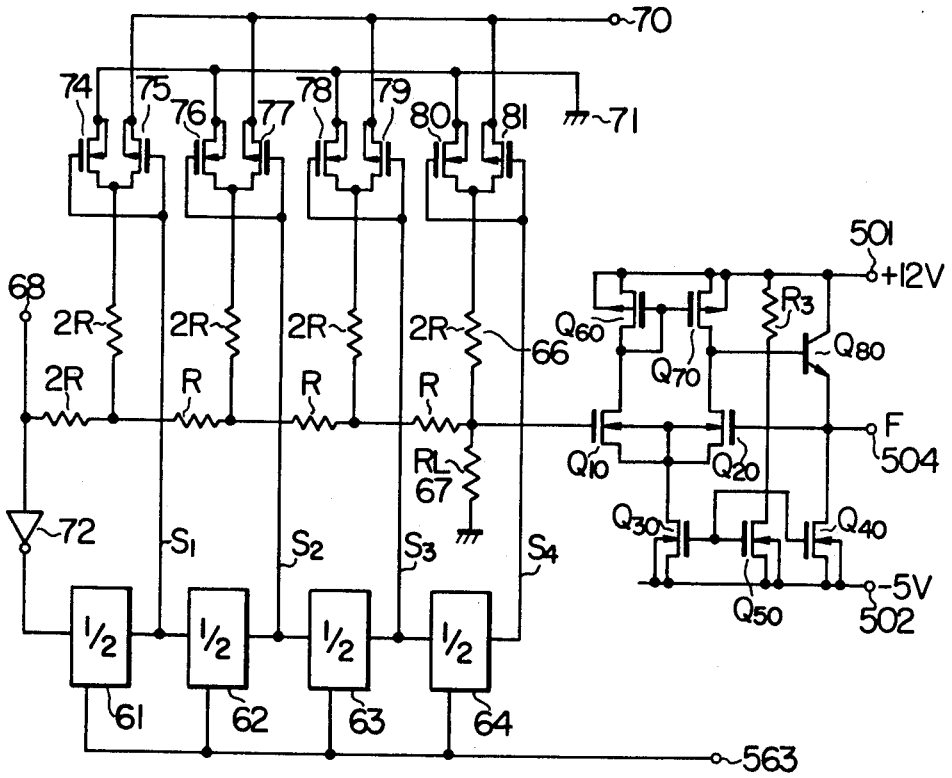
FIG. 43 shows a configuration of a sawtooth wave or staircase wave frequency divider circuit incorporating the impedance converter circuit of the present invention.

An embodiment will next be described in which the impedance conversion circuit of the present invention is applied to an electronic organ using a saw-tooth wave. FIG. 42 shows a portion of a tone generator system for an electronic organ using a saw-tooth wave, in which a saw-tooth wave generator 530 of 16 KHz produces an output voltage 532 at output node 531. Saw-tooth wave frequency dividers 533, 534, 535, 536, 537, encircled by a dotted line, frequency divide by the factors of 2, 4, 8, 16 and 32, respectively, and have corresponding output terminal 539, 540, 541, 542, 543, respectively. The saw-tooth wave generator 530 includes an output terminal 538. In the present embodiment, the impedance conversion circuit of the present invention is used as a buffer for the frequency divided output, and FIG. 43 shows a 1/16 frequency divider section of FIG. 42.

The saw-tooth wave frequency divider is identical to that shown in FIG. 8 and the impedance conversion circuit is identical to that of FIG. 35, and the operations thereof have been described above. By taking out the output of the saw-tooth wave frequency divider from the output terminal 504 using the impedance conversion circuit of the present invention, a saw-tooth wave of low impedance can be provided.

By the use of the impedance conversion system of the present invention in the output stage of the saw-tooth wave frequency divider, the following advantages are provided: (1) Since the input impedance is high, the balance of the ladder network is not lost and the linearity is improved. (2) Since the resistance values of the ladder network may be selected high, the size of the switching element may be reduced, which facilitates the circuit design. (3) Since the D.C. level shift is substantially zero, system design is facilitated. Further, the frequency divider input stage can be used as one output stage as shown in FIG. 42 so that one frequency divider stage may be saved.

As described above, the impedance conversion circuit of the present invention has a significant effect on the saw-tooth frequency division circuit. It is also expected that the present impedance conversion circuit may be equally applicable to the usual D/A converters and provides a significant industrial advantage when integrated with other circuits.

Figure 44:
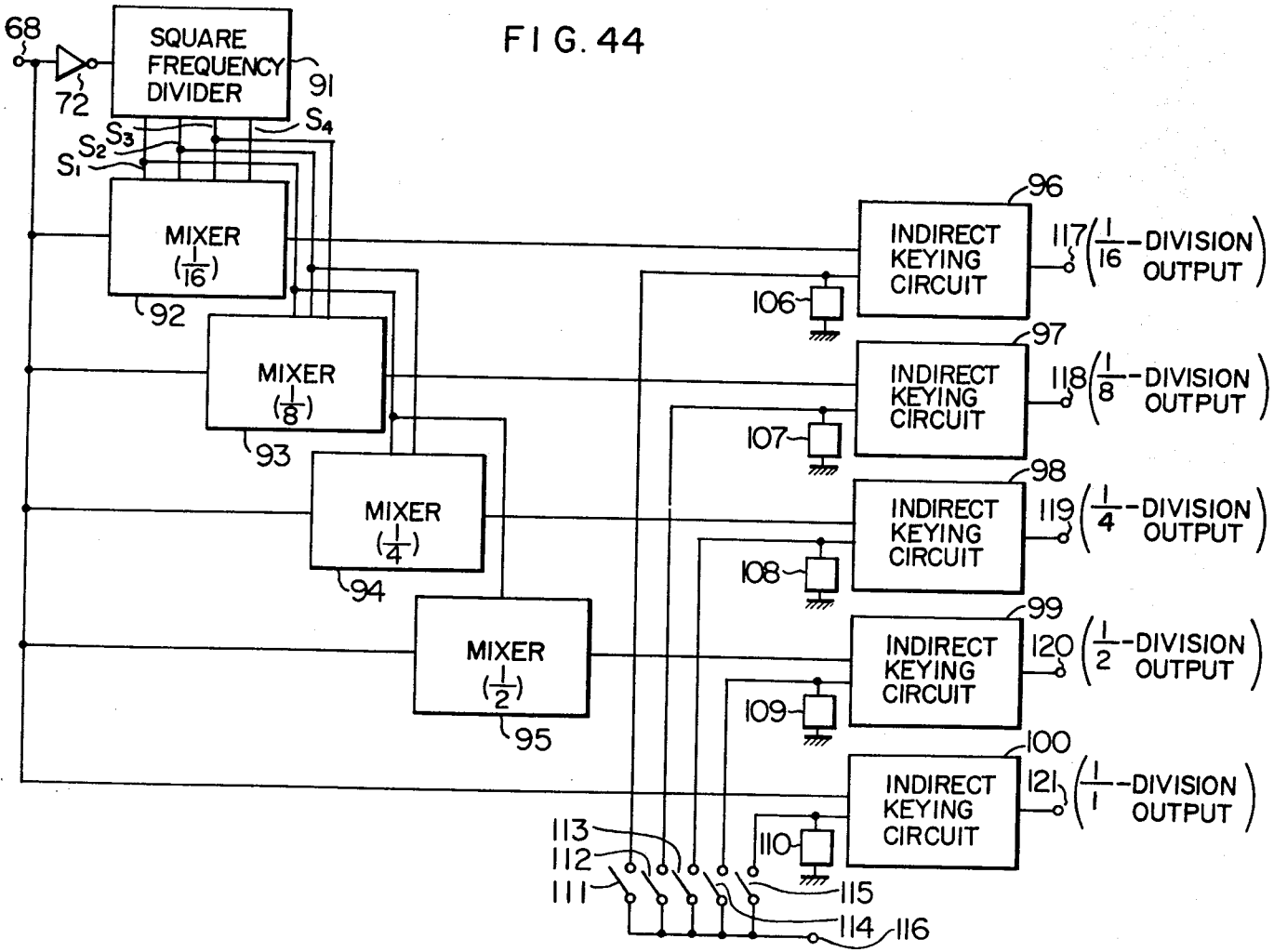
FIG. 44 is an entire block diagram of one embodiment of the tone generator system for an electronic organ.

FIG. 44 shows a tone generator which is constituted by a combination of the saw-tooth wave or staircase wave frequency divider and the indirect keying circuit including analog switch and variable impedance element. This figure differs from FIG. 11 in that a sustain system is additionally included. The impedance circuit is used with the saw-tooth wave frequency divider as shown in FIG. 43.

In FIG. 44, numerals 68 and 72 are the same as that of FIG. 8. Numerals 91, 92, 93, 94 and 95 are mixers of the square frequency divider and the staircase resistor network shown in FIG. 10, and numerals 96, 97, 98, 99 and 100 are indirect keying circuits also shown in FIG. 10. Numerals 106, 107, 108, 109 and 110 are discharging elements for sustain effect and capacitors for charge storing, respectively provided to indirect keying circuits, and form a sustain system together with the indirect keying circuits. Numerals 111, 112, 113, 114 and 115 are keyboard switches, and 116 is a source terminal for receiving a constant voltage.

Numerals 117, 118, 119, 120 and 121 are frequency divider outputs of the saw-tooth wave or staircase wave frequency respectively having frequency division ratios (1/16, $\frac{1}{8}$, $\frac{1}{4}$, $\frac{1}{2}$ and 1) for the input signal, and these five outputs constitute an output for five octaves.

What is claimed is:

1. An indirect keying circuit for a tone generator system of an electronic organ comprising first, second and third field effect transistors each having source, drain and gate regions, the source of said first transistor being connected to the drain of said second transistor and the source of said second transistor being connected to the drain of said third transistor, means connecting the drain of said first transistor and the source of said third transistor to first and second voltage sources respectively, means connecting the gate of said first transistor to a voltage signal source, means connecting the gate of said second transistor to a third voltage source and means connecting the gate of said third transistor to a musical tone source, the means connecting said third voltage source to the gate of said second transistor comprising a switch associated with a keyboard, and means connecting the drain of one of said second or third transistors to an output terminal, said switch alternately connecting and disconnecting a D.C. voltage from said third voltage source to the gate of said second transistor thereby controlling the turning on and off of an output analog signal at said output terminal, the amplitude of said output analog voltage being controlled in accordance with the magnitude of the D.C. voltage from said third voltage source.

2. An indirect keying circuit as defined by claim 1 which further comprises an emitter follower circuit, said emitter follower circuit including a transistor having its base connected to said output terminal.

3. An indirect keying circuit as defined by claim 1 wherein the voltage signal source applied to the gate of said first transistor is an A.C. voltage signal having a predetermined waveform, the output analog signal at said output terminal being amplitude modulated in accordance with said A.C. voltage signal.

4. An indirect keying circuit as defined by claim 1 wherein the gate of said first transistor is connected to said first voltage source.

5. An indirect keying circuit as defined by claim 1 which further comprises a sustain circuit, said sustain circuit including a capacitor and a variable impedance element each having one terminal coupled to the gate of said second transistor and the other terminal connected to said second voltage source, said capacitor and said impedance circuit comprising an RC time constant circuit for gradually varying the rise and fall of the D.C.

voltage applied to the gate of said second transistor through said switch thereby gradually varying the rise and decay of the output analog signal at said output terminal.

6. An indirect keying circuit as defined by claim 5 wherein said variable impedance element comprises a resistance body forming at least a part of the source region of said second field effect transistor, and at least two electrodes provided on said source region, one of said electrodes being coupled to a reference potential and the other electrode having a control voltage applied thereto for producing a potential distribution within said source region.

7. An indirect keying circuit as defined by claim 5 wherein said first, second and third field effect transistors and said variable impedance element are integrated on a single semiconductor chip.

* * * * *